United States Patent [19]

Chodak et al.

[11] 4,363,489

[45] Dec. 14, 1982

[54] ELECTRONIC STOCK MARKET TERMINAL GAME

[75] Inventors: Jan B. Chodak, Rancho Palos Verdes; Luan G. Tran, Redondo Beach, both of Calif.

[73] Assignee: Mattel, Inc., Hawthorne, Calif.

[21] Appl. No.: 197,882

[22] Filed: Oct. 17, 1980

[51] Int. Cl.[3] ..... A63F 3/00; A63F 9/00

[52] U.S. Cl. ..... 273/237

[58] Field of Search ..... 273/1 E, 148 R, 237, 273/256, 278, DIG. 28; 434/107; 364/410

[56] References Cited

U.S. PATENT DOCUMENTS

| | | | |
|---|---|---|---|
| 3,559,993 | 2/1971 | Thomas | 273/278 |
| 3,728,480 | 4/1973 | Baer | 273/DIG. 28 |
| 3,770,277 | 11/1973 | Cass | 273/278 |
| 4,084,194 | 4/1978 | Hector | 273/DIG. 28 |
| 4,126,851 | 11/1978 | Okor | 273/237 |
| 4,156,928 | 5/1979 | Inose et al. | 273/237 |

OTHER PUBLICATIONS

*Saturday Review of the Sciences*; "Monopoly by Computer"; Apr. 1973; pp. 44–48.

*101 Basic Computer Games*; Digital Equipment Corp.; Mar. 1975; pp. 153–155, 209–211.

*Primary Examiner*—Vance Y. Hum

*Attorney, Agent, or Firm*—Reagin & King

[57] ABSTRACT

An electronic stock market game having a plurality of display and input positions at which players may trade in stock listed by the game. Each display shows a player, the price at which a stock is selling and gives general and specific information affecting the price of the stocks. A player selects a stock to trade in and keys in his order. A microprocessor executes the order, if possible, and controls the display to indicate the status of all stocks and the players account. The object of the game is to accumulate assets having over a predetermined value.

29 Claims, 21 Drawing Figures

FIG. 1
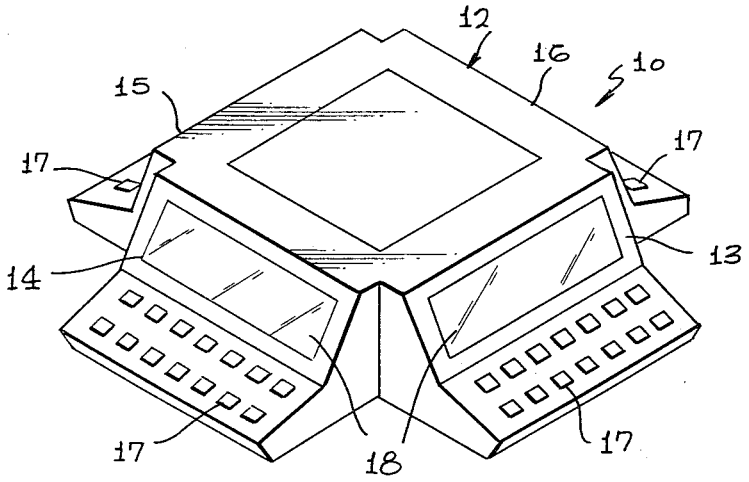
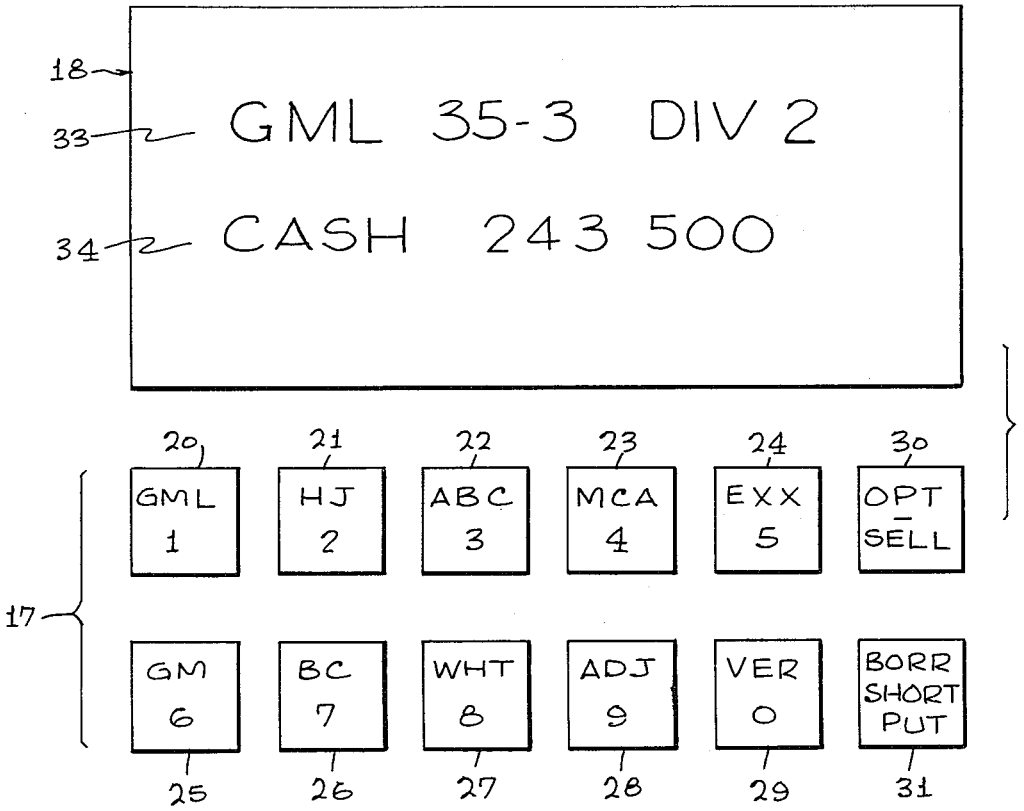
FIG. 2

A

200
SCAN ACCOUNTS OF PLAYER
1
2
3
201
FINISHED SCAN ?
YES
NO
222
STORE SELECTED COMPANY AS "OF INTEREST"
224
SCHEDULE STOCK QUOTE MESSAGE
202
IS THIS SELECTED CO. & DOES PLAYER HAVE OPTION ?
NO
YES
206
ENTER SHORT SALE FOR 2000 SHARES, COMPUTE CASH
208
ADD CASH TO PLAYERS ACCOUNT
SCHEDULE "OPTIONS EXPIRE"
218
204
SHORT SALE ?
YES
NO
210
CALL ?
YES
NO
212
ENTER CALL OPTION, COMPUTE CASH
216
ENTER PUT OPTION, COMPUTE CASH

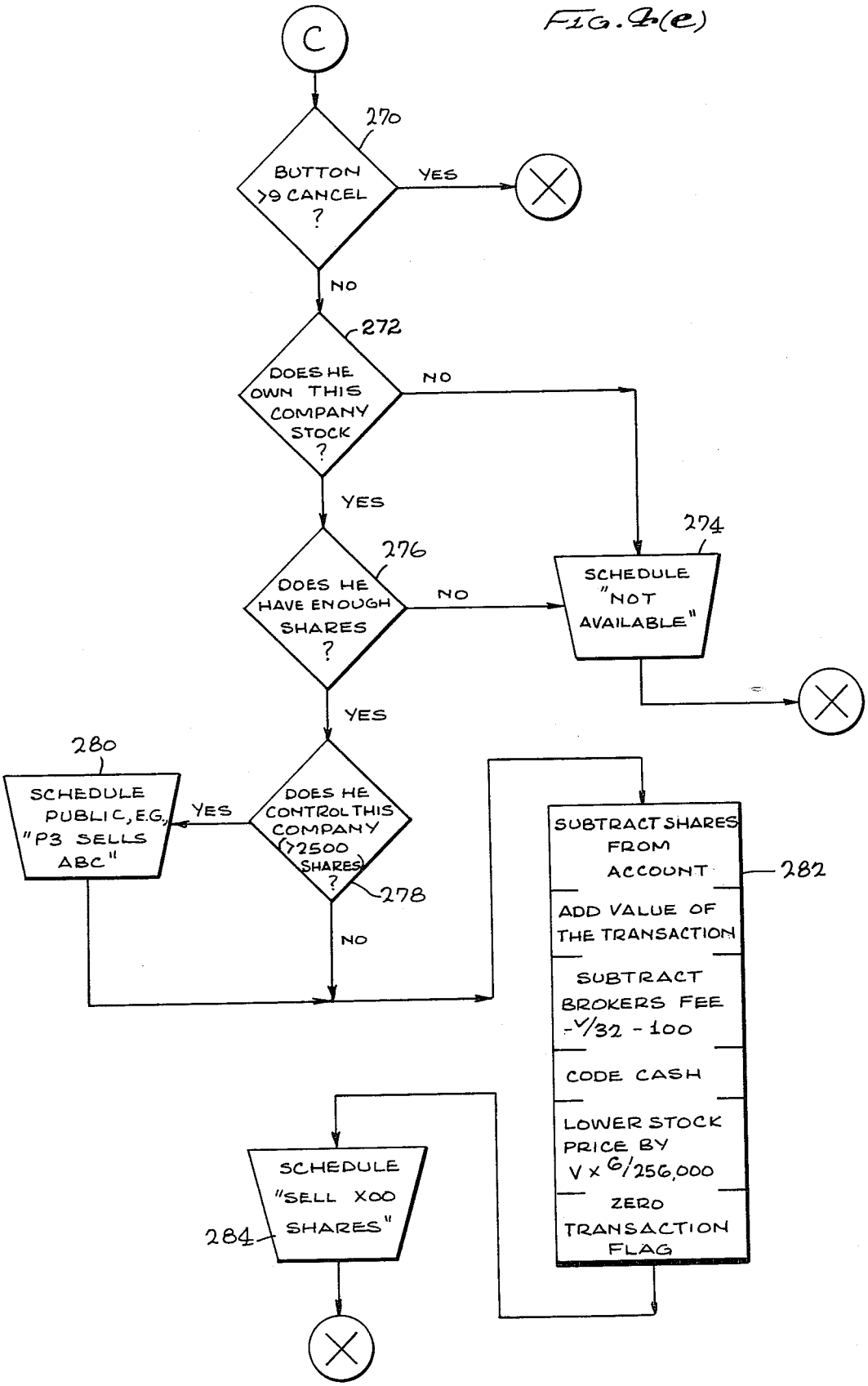
FIG. 4(e)
C
270
BUTTON >9 CANCEL ?
YES
NO
272
DOES HE OWN THIS COMPANY STOCK ?
NO
YES
274
SCHEDULE "NOT AVAILABLE"
276
DOES HE HAVE ENOUGH SHARES ?
NO
YES
280
SCHEDULE PUBLIC, E.G., "P3 SELLS ABC"
YES
DOES HE CONTROL THIS COMPANY (>2500 SHARES) ?
278
NO
SUBTRACT SHARES FROM ACCOUNT
282
ADD VALUE OF THE TRANSACTION
SUBTRACT BROKERS FEE -V/32 - 100
CODE CASH
LOWER STOCK PRICE BY V x 6/256,000
ZERO TRANSACTION FLAG
SCHEDULE "SELL X00 SHARES"
284

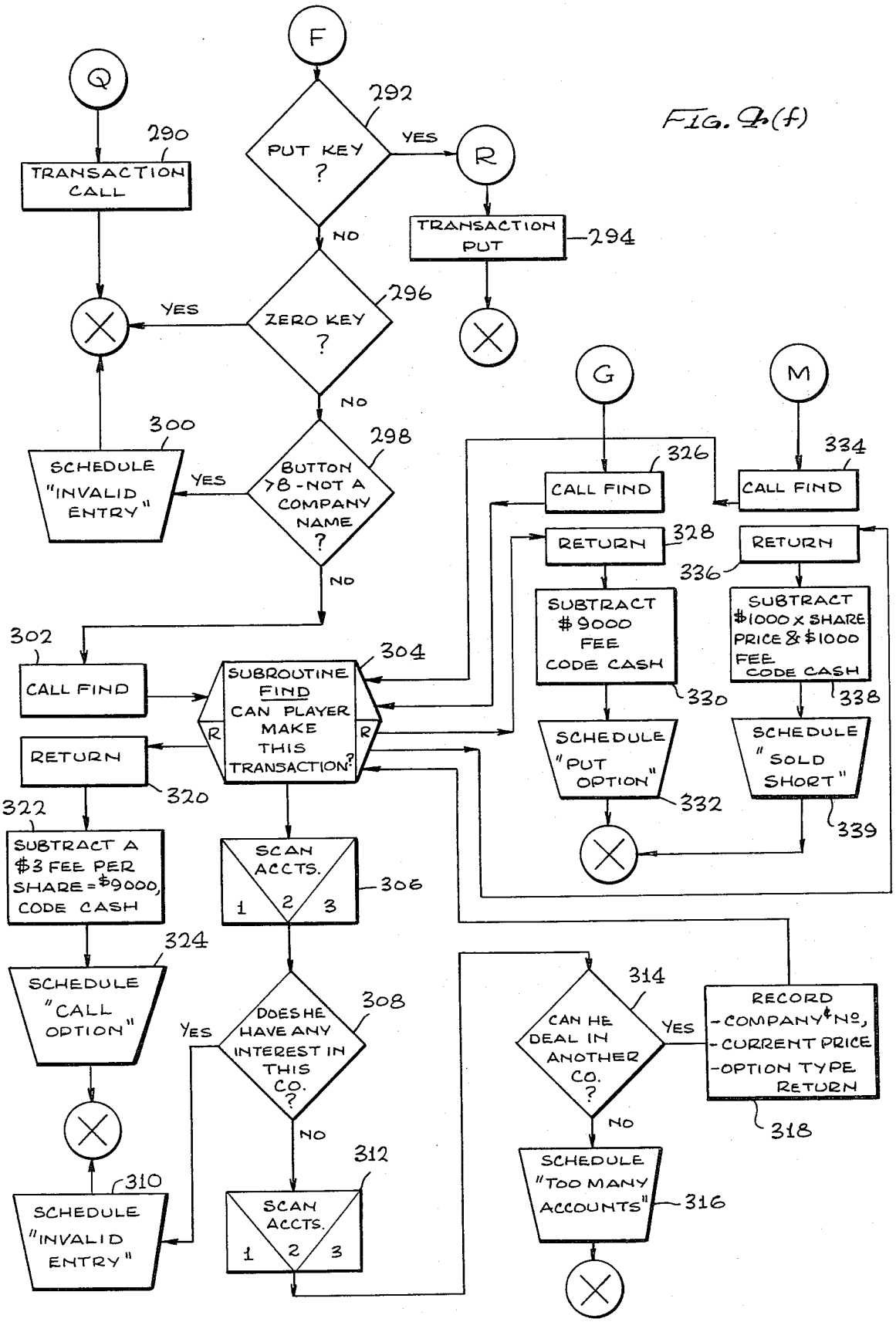
FIG. 9(f)
F
Q
TRANSACTION CALL
290
PUT KEY ?
292
YES
R
TRANSACTION PUT
294
NO
ZERO KEY ?
296
YES
NO
SCHEDULE "INVALID ENTRY"
300
BUTTON >8 - NOT A COMPANY NAME ?
298
YES
NO
CALL FIND
302
SUBROUTINE FIND CAN PLAYER MAKE THIS TRANSACTION?
304
R
R
RETURN
320
SUBTRACT A $3 FEE PER SHARE = $9000, CODE CASH
322
SCHEDULE "CALL OPTION"
324
SCAN ACCTS.
1 2 3
306
DOES HE HAVE ANY INTEREST IN THIS CO. ?
308
YES
NO
SCHEDULE "INVALID ENTRY"
310
SCAN ACCTS.
1 2 3
312
G
M
CALL FIND
326
CALL FIND
334
RETURN
328
RETURN
336
SUBTRACT $9000 FEE CODE CASH
330
SUBTRACT $1000 x SHARE PRICE & $1000 FEE CODE CASH
338
SCHEDULE "PUT OPTION"
332
SCHEDULE "SOLD SHORT"
339
CAN HE DEAL IN ANOTHER CO. ?
314
YES
NO
RECORD - COMPANY & No., - CURRENT PRICE - OPTION TYPE RETURN
318
SCHEDULE "TOO MANY ACCOUNTS"
316

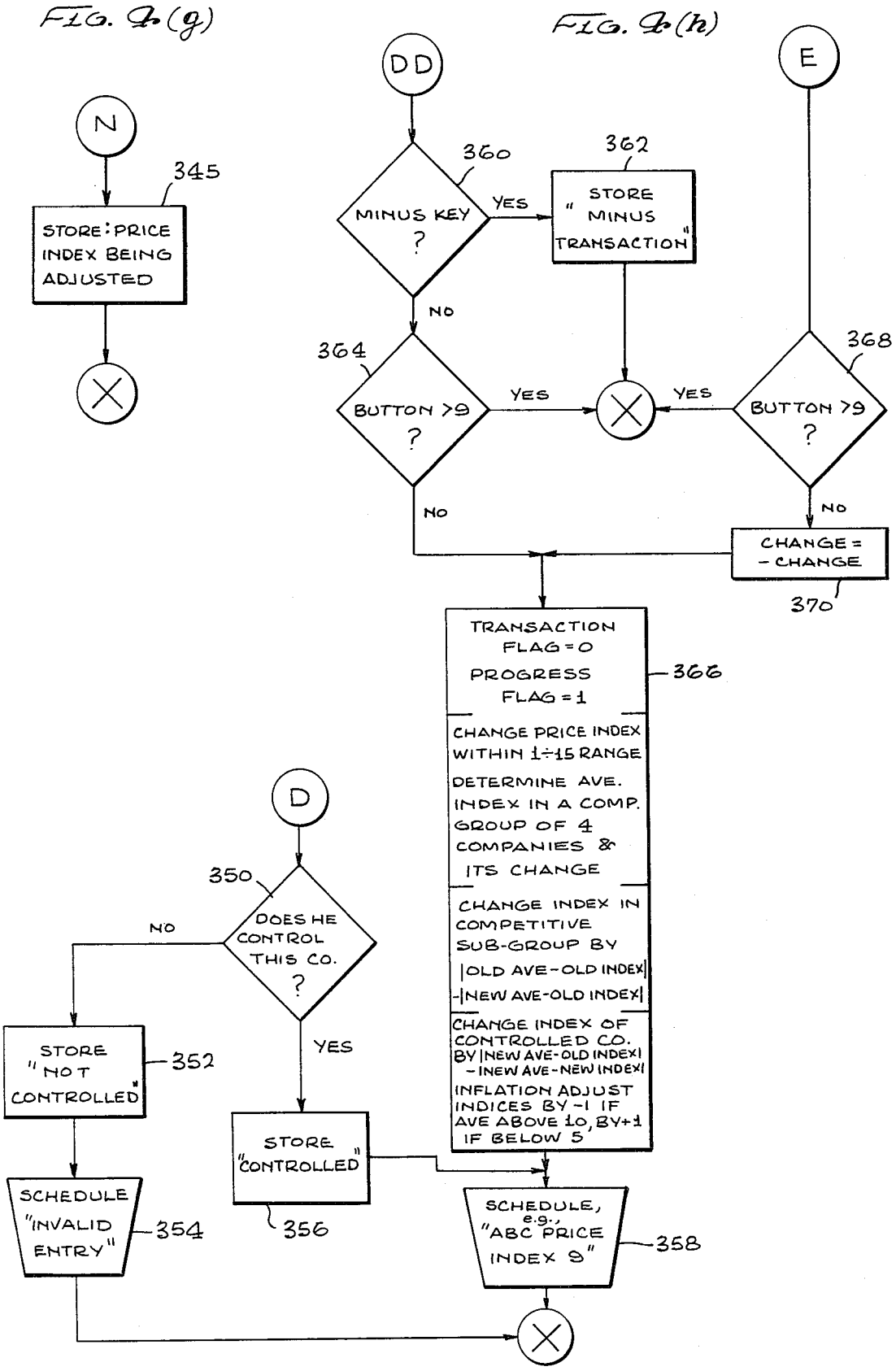
FIG. 9(g)
FIG. 9(h)
N
345
STORE: PRICE INDEX BEING ADJUSTED
DD
E
360
MINUS KEY ?
YES
362
STORE "MINUS TRANSACTION"
NO
364
BUTTON >9 ?
YES
YES
368
BUTTON >9 ?
NO
NO
CHANGE = - CHANGE
370
TRANSACTION FLAG = 0
PROGRESS FLAG = 1
366
CHANGE PRICE INDEX WITHIN 1÷15 RANGE
DETERMINE AVE. INDEX IN A COMP. GROUP OF 4 COMPANIES & ITS CHANGE
CHANGE INDEX IN COMPETITIVE SUB-GROUP BY |OLD AVE-OLD INDEX| -|NEW AVE-OLD INDEX|
CHANGE INDEX OF CONTROLLED CO. BY |NEW AVE-OLD INDEX| - |NEW AVE-NEW INDEX|
INFLATION ADJUST INDICES BY -1 IF AVE ABOVE 10, BY +1 IF BELOW 5
D
350
DOES HE CONTROL THIS CO. ?
NO
YES
STORE "NOT CONTROLLED"
352
STORE "CONTROLLED"
356
SCHEDULE "INVALID ENTRY"
354
SCHEDULE, e.g., "ABC PRICE INDEX 9"
358

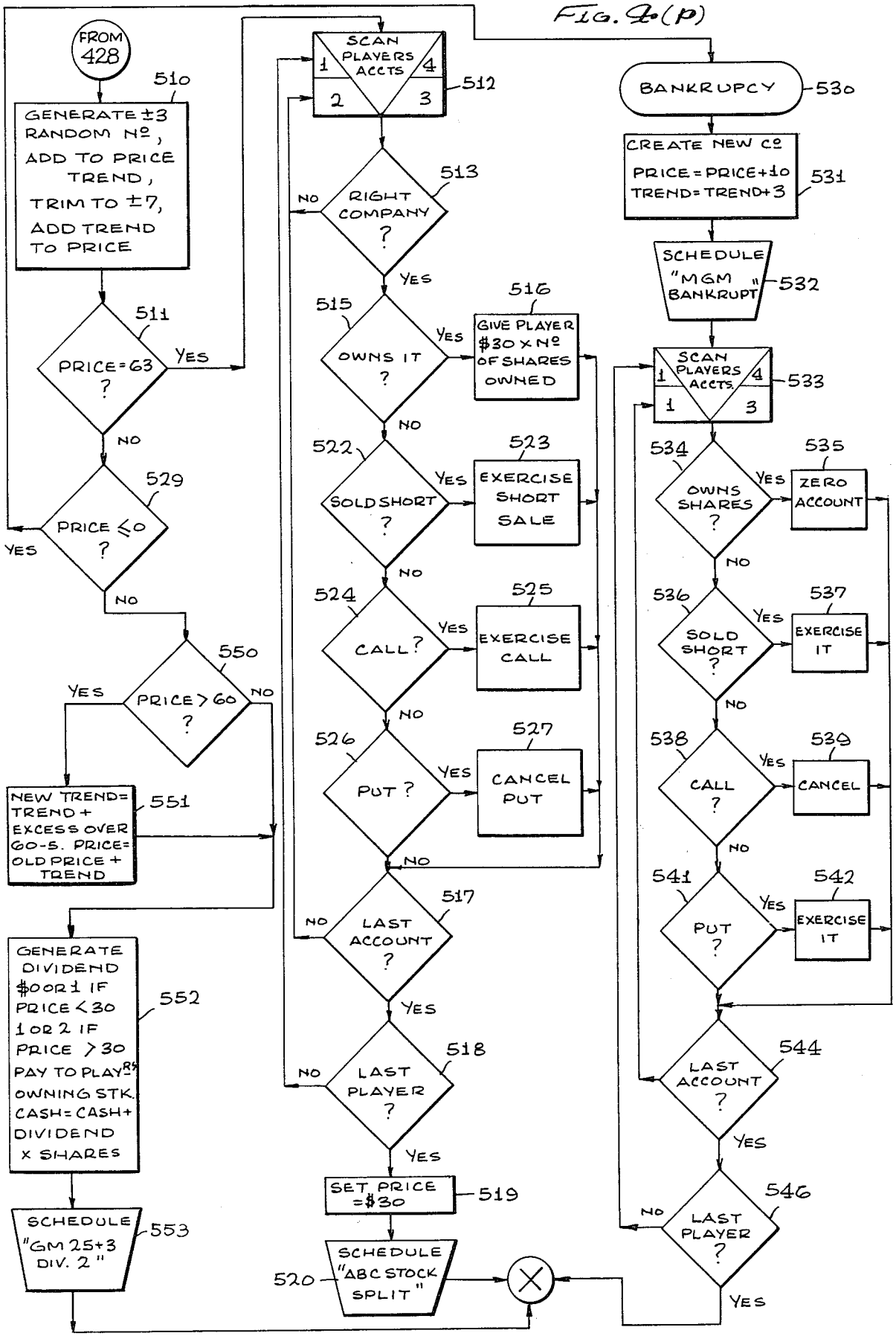
FIG. 9(P)
FROM 428
510
GENERATE ±3 RANDOM Nº, ADD TO PRICE TREND, TRIM TO ±7, ADD TREND TO PRICE
511
PRICE=63 ?
YES
NO
529
PRICE ≤0 ?
YES
NO
550
PRICE > 60 ?
YES
NO
551
NEW TREND= TREND + EXCESS OVER 60-5. PRICE= OLD PRICE + TREND
552
GENERATE DIVIDEND $0 OR 1 IF PRICE < 30 1 OR 2 IF PRICE > 30 PAY TO PLAYERS OWNING STK. CASH= CASH+ DIVIDEND X SHARES
553
SCHEDULE "GM 25+3 DIV. 2"
512
SCAN PLAYERS ACCTS
1 2 3 4
513
RIGHT COMPANY ?
NO
YES
515
OWNS IT ?
YES
516
GIVE PLAYER $30 X Nº OF SHARES OWNED
NO
522
SOLD SHORT ?
YES
523
EXERCISE SHORT SALE
NO
524
CALL ?
YES
525
EXERCISE CALL
NO
526
PUT ?
YES
527
CANCEL PUT
NO
517
LAST ACCOUNT ?
NO
YES
518
LAST PLAYER ?
NO
YES
519
SET PRICE =$30
520
SCHEDULE "ABC STOCK SPLIT"
530
BANKRUPCY
531
CREATE NEW Cº PRICE = PRICE+10 TREND= TREND+3
532
SCHEDULE "MGM" BANKRUPT
533
SCAN PLAYERS ACCTS
1 2 3 4
534
OWNS SHARES ?
YES
535
ZERO ACCOUNT
NO
536
SOLD SHORT ?
YES
537
EXERCISE IT
NO
538
CALL ?
YES
539
CANCEL
NO
541
PUT ?
YES
542
EXERCISE IT
544
LAST ACCOUNT ?
YES
546
LAST PLAYER ?
NO
YES

SHEET 1 OF 2

SHEET 2 OF 2

ELECTRONIC STOCK MARKET TERMINAL GAME

BACKGROUND OF THE INVENTION

This invention relates to games and, more particularly, to an electronic stock market game.

There have been many attempts to capture the essence of the marketplace in games. It seems clear that if the elements which lend the excitement, despair, and elation to the marketplace could be captured in a game then such a game would be an instant commercial success. The longevity of interest in the wall known Monopoly game demonstrates the attraction of games related to the marketplace.

However, most of those games heretofore devised to simulate the marketplace are, like the above-mentiond game, board games which seem to totally divorced from the real situations encountered in the marketplace that their attempts to simulate fall far short of the reality.

It is, therefore, an object of the present invention to provide a game which realistically simulates the operation of the stock market.

It is another object of this invention to provide an electronic game in which a number of players compete against one another in accumulating wealth by buying and selling stocks and in taking part in other transactions which closely simulate those of the stock market.

It is yet another object of this invention to provide an electronic stock market game which simulates the activities carried on on an actual stock market and which simulates the effect of different economic conditions on the stock in which the market deals.

SUMMARY OF THE INVENTION

The foregoing and other objects of the invention are accomplished by an electronic stock market game which simulates buying, selling, and other transactions on a stock exchange and which provides for the interplay of market factors to affect the price of the stocks and the conditions of the companies. Each of a number of players have individual electronic displays each of which simulates the display on the board at a stock exchange or at an individual stock market terminal. The information presented on the displays is used by the players in deciding to deal in particular stocks. The displays present a limited number of stocks, their prices, their dividends, and various other information which may affect the market for a particular stock. Associated with his display, each player has a keyboard for inter alia buying, selling, selling short, placing calls, and placing puts with respect to stock listed by the display. The object of the game for each player is to acquire more than a particular sum of money.

A microprocessor controls the displays and keeps track of the stocks, their ownership, their price, totals of cash and stock owned by each player, and the like. The microprocessor also makes sure that the rules of the game are followed by the players.

Other objects, features, and advantages of the invention will become apparent from the specification taken in conjunction with the drawings in which like elements are referred to by like reference designations throughout the several views.

BRIEF DESCRIPTION OF THE DRAWINGS

FIG. 1 is a perspective view of a stock market game constructed in accordance with the invention;

FIG. 2 is a detailed view of a display and a keyboard which may be used by an individual player in the game of this invention;

DESCRIPTION OF THE PREFERRED EMBODIMENTS

Figure 3:
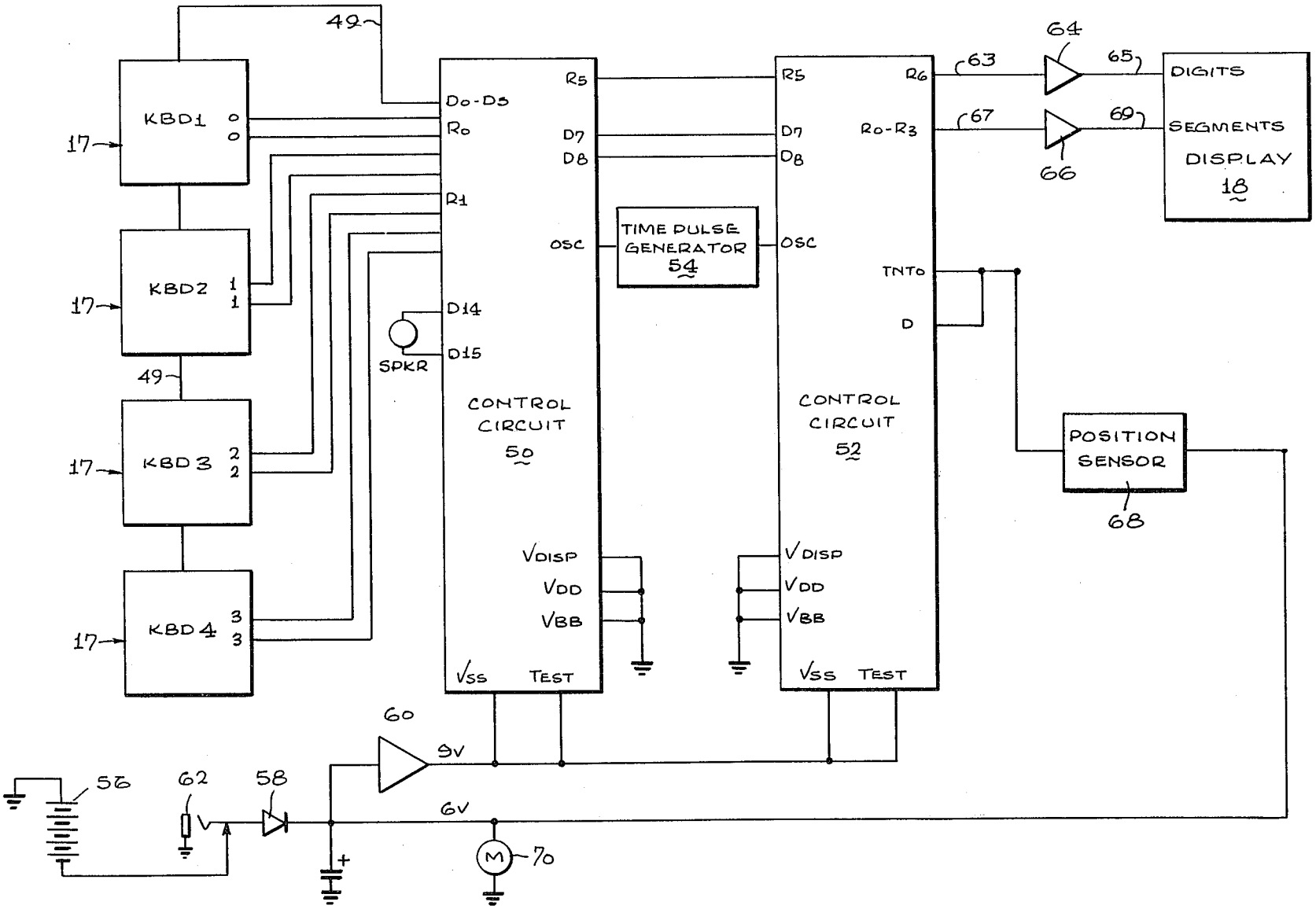
FIG. 3 is a schematic/block diagram illustrating the circuitry of the game of this invention.
Figure 9B:
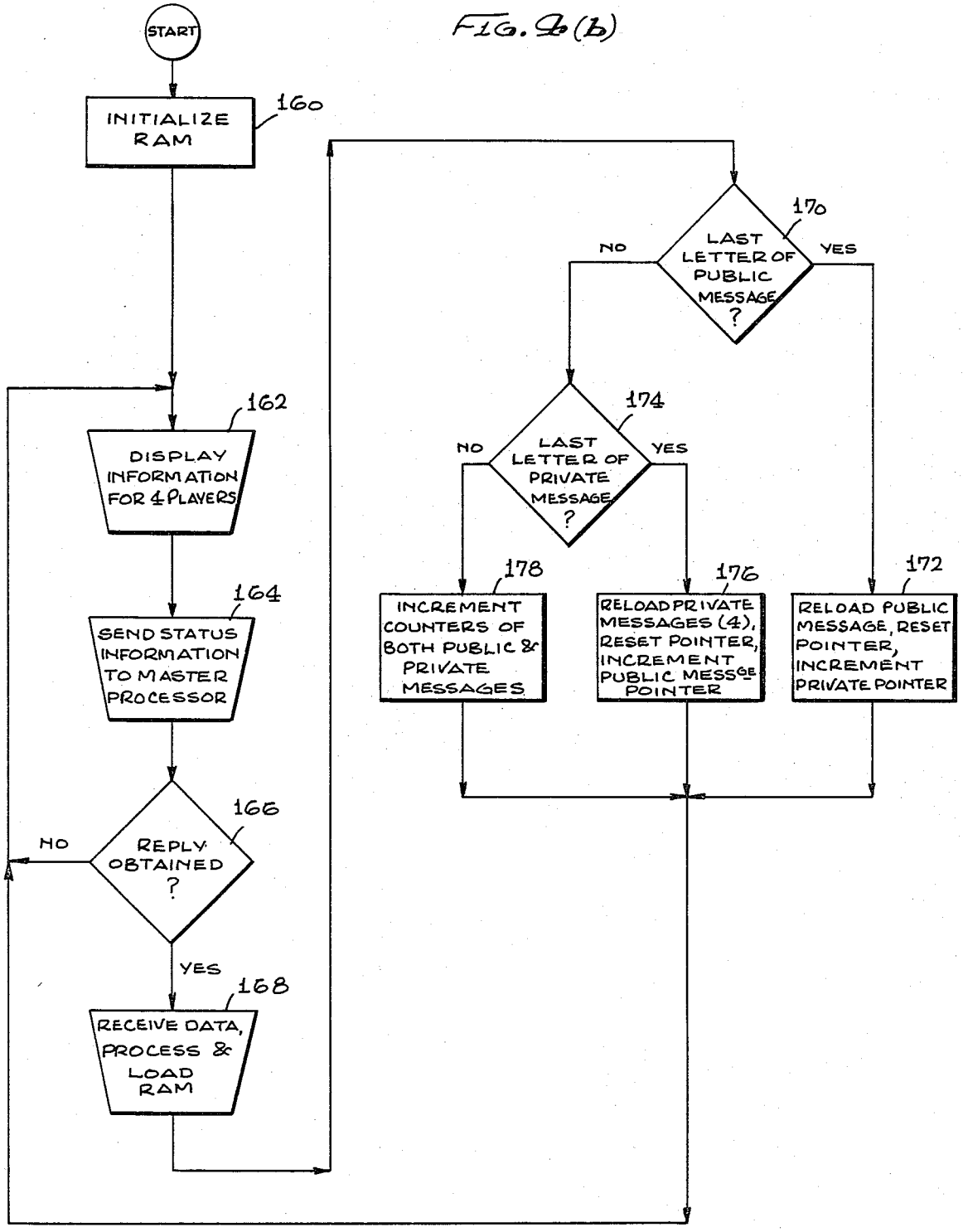
Figure 9D:
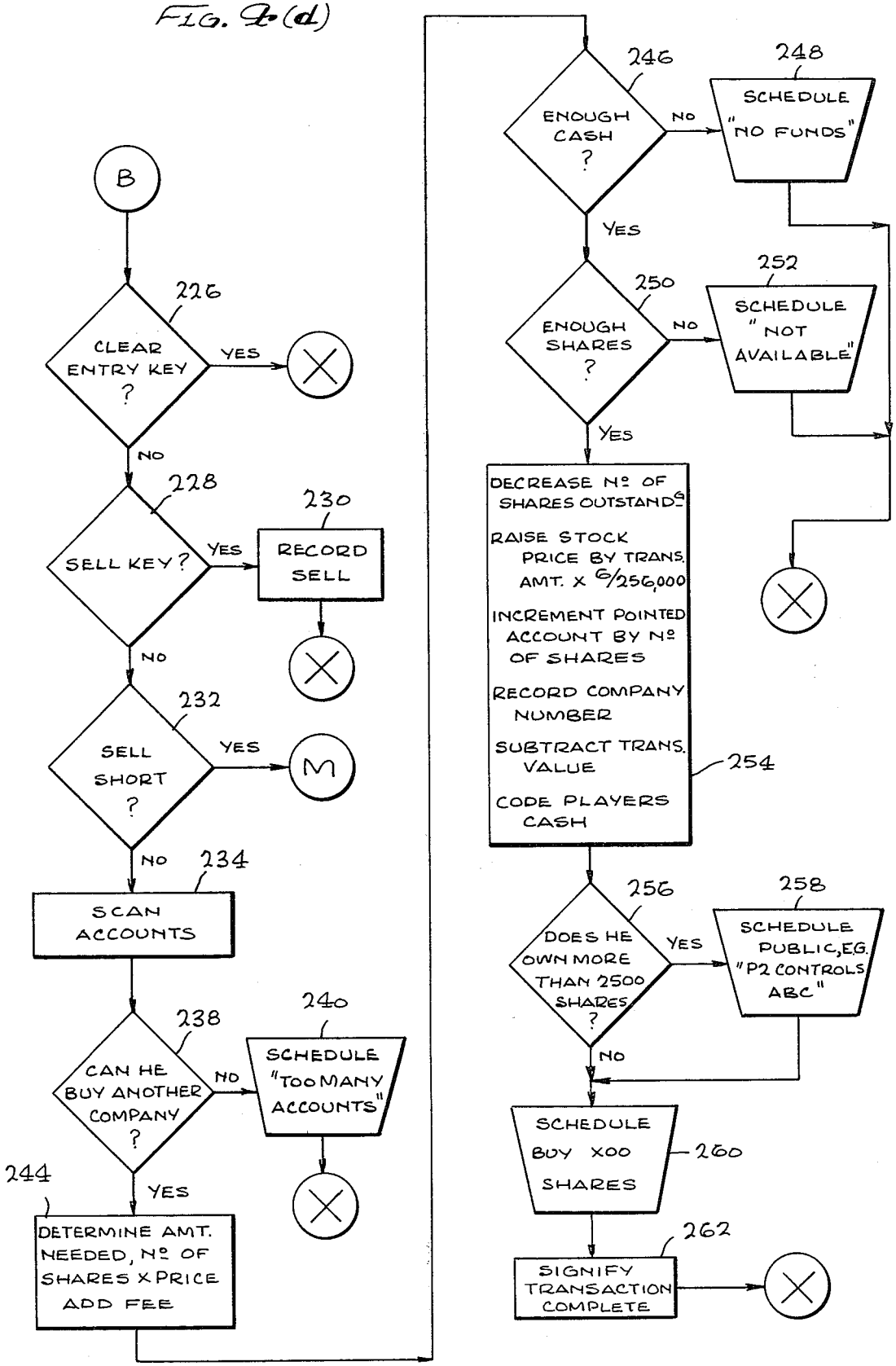
Figure 9I:
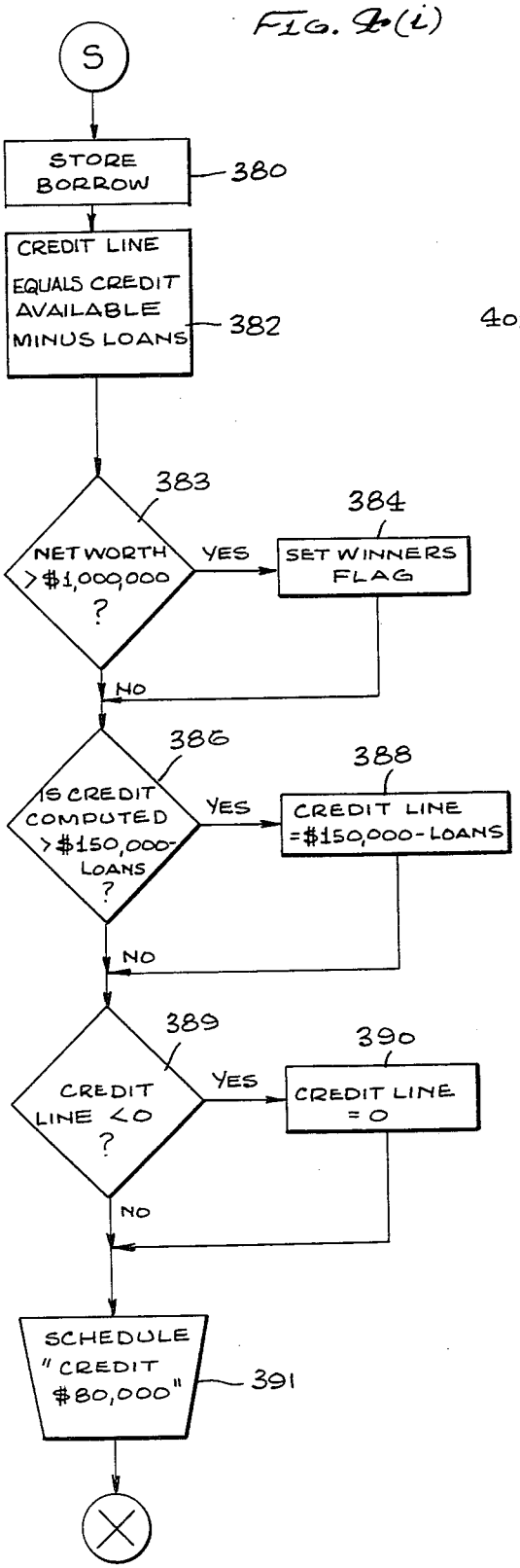
Figure 9J:
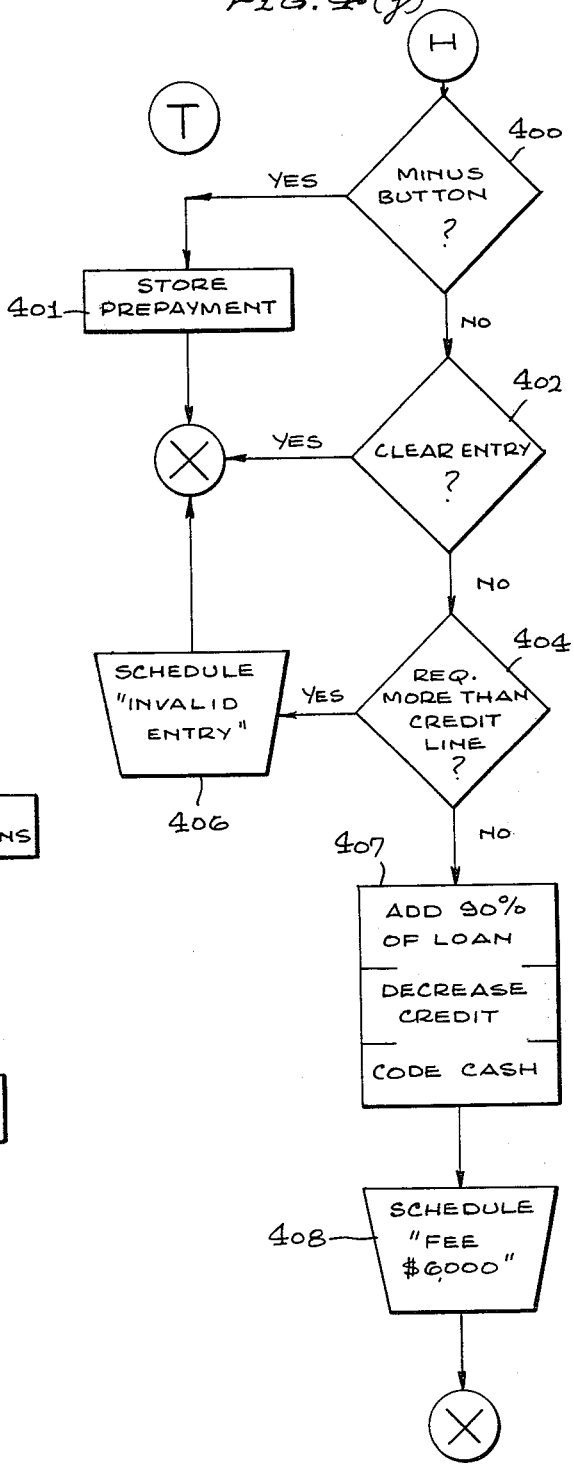

Referring now to FIG. 1 there is shown a perspective view of a game constructed in accordance with the invention. The game 10 comprises a housing 12 having four player positions 13, 14, 15, and 16. Each of the player positions has a keyboard 17 and a display 18.

The keyboard 17 and the display 18 utilized by each player are more clearly shown in FIG. 2 which is a view of one player position taken directly into each of the keyboards 17 and the display 18 for clarity of understanding. As may be seen in FIG. 2, the keyboard 17 includes twelve keys, buttons, or switches 20–31. The keys 20–29 each have a company stock market identification printed on the upper face thereof and one of the numbers from zero through nine printed on the lower face thereof. The key 30 has the letters "OPT" (which indicate option) printed on the upper face, a minus sign printed in the middle of the face, and letters "SELL" printed on the lower face. The key 31 has the letters "BORR" (which indicate borrow) printed on the upper face thereof, the letters "SHORT" on the middle face thereof, and the letters "PUT" on the lower face thereof. The keys 20–31 are used by a player for indicating the actions he desires to take with respect to the various stocks with which the game is played.

The display 18 has means for presenting various alphanumeric information on an upper display line 33 (referred to as a public display) and a lower display line 34 (referred to as a private display). The means for displaying the alphanumeric information can comprise any of a number of means well known to the art such as light emitting diodes (LEDs), bulbs, or other means for forming letters and numbers. However, the preferred embodiment utilizes a rotating mirror display such as that disclosed in U.S. Patent Application Ser. No. 167,569 entitled "Display for Electronic Games and the Like," filed July 11, 1980 assigned to the assignee of the present invention. Such a display has the advantage of easily and inexpensively providing a message which scrolls from the right side of the display to the left in the manner of a stock market terminal display. The utilization of a display which preferably scrolls from right to left enhances the reality of the simulation of the stock market transactions provided by the game of this invention.

As may be seen in FIG. 1, four or less players may conveniently play the game in the preferred embodiment. Each of the players has a display 18 and on each display 18 appears the information presented in the public display 33. Most often during the operation of the game, the information shown on the public display 33 includes the stock prices of the individual companies, the most recent change in those prices, and the most recently declared dividend. A typical message of this type is shown in FIG. 2 in public display 33 as "GML 35 -3 DIV 2." This may be translated to mean that the General Mills Company is presently selling for thirty five dollars, a price which is three dollars less than the last price quoted for General Mills; and that General Mills has recently paid a dividend of two dollars per share.

In addition, the public display 33 of each display 18 presents information relating to the buying, selling, and other transactions of a player who controls more than half of the shares of any particular company listed in the game. The public display also, in the preferred embodiment, presents information that a particular player has won or a particular player has lost the game.

The public display 33 also presents information affecting the simulated market, specific companies, and groups of companies. For example, the messages "NEW PRODUCT," "DEMAND UP," "COSTS DOWN," and "DEREGULATED" preceded by a company indication such as "GML" indicate that (in the preferred embodiment of the game) a four dollar price increase in the trend of the price of the stock will take place. In contrast, the following messages "NEW ENTRANT," "DEMAND DOWN," "COSTS UP," and "REGULATED" indicate when preceded by a company indication that the particular company will experience a drop in the average trend by four dollars. Moreover, the messages "DROUGHT," "BUMPER HARVEST," "HOUSING DOWN," "HOUSING UP," "OPEC PRICE UP," "U.S. ENERGY SOURCE," "CABLE EXPANSION," and "HIT MOVIES" cause those companies in the food, housing, automotive and entertainment industries, respectively, to experience an increase or drop in their trend of the stock price because of their participation in the particular industry. The price trend of a company is an amount by which the stock varies (on an average) from quote to quote.

In addition, the indications "GNP UP," "M-1 STABLE," "BALANCED BUDGET," "POPULATION UP," "INVESTMENT UP," and "PRODUCTIVITY UP" appearing on the public display 33 will have an optimistic effect on all of the companies listed in the game. The indications "GNP DOWN," "M-L EXCESSIVE," "DEFICIT OF," "INVESTMENT DOWN," "PRODUCTIVITY DOWN," and "TARIFFS UP," on the other hand, will have an opposite effect on all of the companies. That effect, however, will vary depending on the particular company, as is true of the effect on different companies in different industries in the actual stock markets.

The table below lists the particular effect in a preferred embodiment on each company each of the pieces of economic news listed in the last paragraph above will have. Optimistic economic news causes the price trend of the particular stock to increase by the value shown while negative economic news will cause the price trend of the stock to decrease by the amount indicated.

| | | | | |
|---|---|---|---|---|
| Food Industry | GML | (1) | HJ | (2) |
| Entertainment | ABC | (2) | MCA | (2) |
| Automotive | EXX | (2) | GM | (3) |
| Housing | BC | (3) | WHT | (3) |

Each of the individual private displays 34 normally displays the cash-on-hand of the player operating the display. In addition, each display 34 shows various messages related to the particular transactions chosen by the individual player and other information affecting that player. For example, private display 34 indicates a "COMMODITY LOSS" of thirty thousand dollars, a "REAL ESTATE LOSS" of twenty thousand dollars, "TAXES" of fifteen thousand dollars, "CAPITAL GAINS" of thirty thousand dollars, "TAX REDUCTION" of twenty thousand dollars, an "INHERITANCE" of thirty thousand dollars, and issues "MARGIN" calls to unfortunate players in a preferred embodiment. In addition, the winner and any player who loses each receives an indication of his winning or losing on the private display 34 associated with his play. Additional messages are also provided on the private display 34 which relate to the particular transactions undertaken by a player. These messages are therefore referred to below in describing the transactions.

As shown in FIG. 2 each of the keys 20–27 has a company indication at the upper face thereof in the preferred embodiment. Those companies are: GML-General Mills, HJ-Howard Johnson's ABC-American Broadcasting Company, MCA-Merchandising Corporation of America, EXX-Exxon, GM-General Motors, BC-Boise Cascade, and WHT-White Westinghouse. Consequently, each of these keys 20–27 is utilized in signifying a particular company with regard to which a transaction is to take place. Further, each of the keys 20–29 has indicated thereon a particular number which may be used to select a particular number of shares with respect to the transaction. In the preferred embodiment of the game, the shares are selected in groups of one hundred or more up to nine hundred so that depressing any particular key 20–28 will indicate that the transaction is to involve from one to nine hundred shares. The key 29 is used when it is desired to cancel a transactionn after it has begun by indicating no shares are affected. In addition, the key 30 is utilized in excercising various option transactions, to indicate a negative number, and in selling shares. The key 28 is also used in adjusting the price index of company goods, and the key 29 is used to verify the net worth of a particular player. The key 31 is used in transactions involving borrowing, selling short, and in transacting a put or a call.

RULES OF THE GAME

In playing the preferred embodiment of the game, each player initially receives credit from the control circuitry for having one hundred thousand dollars in cash and a credit line of one hundred thousand dollars. A player's credit line varies linearly from zero at the point at which he has a negative net worth of one hundred thousand dollars to one hundred and fifty thousand dollars at the point at which his net worth is two hundred thousand dollars or more.

Each player may buy stock in companies listed by the game so that he holds, at most, the stock of three companies at any time. As explained, purchases and sales are made in increments of from one hundred to nine hundred shares of stock. For each of the eight companies listed, five thousand shares of stock are outstanding initially and may be purchased by the players. Since companies may be purchased in increments of one hundred shares or more, control of a company is acquired when a player owns two thousand six hundred shares of that company. After a player acquires control of a company, his transactions in the stock of that company are listed on the public display 33 of each player. The price of a share of stock is initially set at random by the control circuitry of the game at an amount between one and sixty dollars. As more shares of a particular stock are purchased, the price of that stock increases. In like manner, the sale of shares causes a reduction in the price of the shares.

Apart from the demand influenced change in price of a particular stock, each stock is initially assigned at random by the control circuitry a price trend, a direction in and rate at which the price of the shares of that stock will move. A trend may have a rate of from one to seven and a positive or negative direction. For example, as the game opens, General Motors may be assigned a negative trend of three so that on each round of quotes (a round is eight quotes of share prices, one such quote for each stock listed) its price will decrease on an average by three points. Superimposed upon the trend, however, is a random variation in the price of the stock which will average zero and will cause the stock price trend to be hidden from careless players.

When a stock with an upward trend reaches a price of sixty, it either splits or starts a downward price trend. The selection of a split or a downward price trend occurs at random with a probability of a split being one in seven.

If a stock price goes to zero or below, the company is declared bankrupt, the shares become valueless, and on the next round of quotes a new company with the same name will be formed with a new stock price, a new trend, and no owners.

Dividends are paid with shares of stocks below a thirty dollar value receiving a dividend of between zero and one dollar and shares of stocks above a thirty dollar value receiving from one to two dollars.

Because the number of shares of each particular company are limited to five thousand, when a stock splits the owner of a particular number of shares is credited with cash amounting to thirty dollars per share owned (one half of the top price of sixty dollars) and retains his original number of shares. He may theoretically purchase more shares in the company with the extra cash received from the stock split if those shares are then available on the market.

At each margin call, each verification of net worth of a player, and each request for a loan, a player's net worth is verified. When a player's net worth is greater than one million dollars, he is declared the winner of the game.

As explained above, random occurrences such as real estate losses occurring, commodity losses occurring, and taxes being levied require the payment by the players of amounts to the bank of the game and are immediately collectable by the control circuitry. If these amounts cannot be collected, the player may be declared a loser.

As explained above, stock prices fluctuate in response to randomly generated economic events. The various economic messages (which are company specific, industry specific, or industry wide) are announced on the displays 33. The effect of these economic announcements is to increase or to decrease the price trend of a particular stock, of the stock of companies in a particular industry, or of all stock. For example, the announcement "GML-New Product" causes the price trend of General Mills to increase for four dollars. Thus, if General Mills had a negative price trend up three dollars at the announcement, it would thereafter have a positive one dollar price trend and its share value from that point on would tend to increase by one dollar (ignoring random variation in price) with each round of price quotes.

An industry wide announcement such as "DROUGHT" on the displays 33 cause those companies in the food industry (General Mills and Howard Johnson's) to suffer a decrease of four dollars in their price trend. Thus, if General Mills had a positive price trend of five dollars at the time of the announcement, it would thereafter have a price trend of plus one dollar for each round of quotes. Howard Johnson's price trend would be affected in a like manner.

General economic indicators such as "GNP DOWN" cause all companies to suffer a deleterious effect in their price trends by the amount set forth above. All of these economic factors constantly affect the price of the shares of stocks available and thereby make predicting the price of a stock a more difficult process and thereby enhance the excitement of the game.

When a player acquires control of a company, he is given the ability to affect the price of the company by changing the price index of the company, By depressing the adjust key 28, followed by a key with that company's name, a player may adjust the price index for his controlled company by an amount keyed in by depressing of the keys 20–29 in a positive sense and (if preceded by the minus key 30) in a negative sense.

The price index of a company is, in effect, an average related to the prices charged by competitive companies in an industry. For the purposes of the game, in the preferred embodiment the food and entertainment companies are considered as one group of competitive companies while the automotive and housing companies are considered as a second group of competitive companies. An average price index for a group of companies ranges from five to ten while an individual company's price index ranges from one to fifteen.

By depressing the adjust button 28 followed by a company indication key 20–27, the control circuitry is caused to display on the private display 34 an indication of the price index for that company. If the price index appears to be below what one would expect the average to be, the player may increase the price index by pushing a numerical button 20–28 to indicate the increase. A player may decrease the price index by depressing the minus key 30 followed by one of the numerical keys 20–28. In response to such action by the player, the control circuitry causes display 34 to confirm the new price index for the company. For every dollar the player brings his price index closer to the average price index for the industry, the company's price trend improves by a dollar; in contrast, for every dollar a player moves away from the average price index, the price trend decreases by a dollar for the company.

PLAY OF THE GAME

To buy shares of a stock a player first pushes one of the keys 20–27 to select a particular company. Depressing one of the keys 20–27 causes the company indication and a price of a share of stock to appear in the player's private display 34. The player next depresses one of the keys 20–29 to indicate the number of shares (from one hundred to nine hundred) which he wishes to purchase. The internal control circuitry of the game first checks to determine whether that particular player owns the stock of three different companies. If the player does, the control circuitry next checks to determine whether the particular company for which the quote has been obtained and in which shares are to be purchased is one of the three companies owned by the player. If the player already owns three other companies, the display indicates "TOO MANY ACCOUNTS" and refuses to carry through the transaction. If the player owns less than the stock of three companies or if the selected company is one of the companies already owned by the player, the control circuitry next checks to determine whether enough shares are available to complete the transaction. If insufficient shares area available, the display 34 indicates "NOT AVAILABLE." If sufficient shares are available, the control circuitry next checks to determine whether the player has sufficient cash to purchase the shares. If the player has insufficient cash, the display 34 indicates "NO FUNDS." If the player has sufficient cash, the transaction is completed by the control circuitry; and the display 34 shows the number of shares of the company purchased on the player's private display 34. If, however, the player owns more than a controlling interest in the company, the information is also displayed to all of the players on the public displays 33. The control circuitry also computes the player's remaining cash by subtracting the cost of the shares and a fee of approximately three percent from the cash on hand.

To sell shares in a company, a player selects the company by depressing one of the keys 20–27 carrying the indication of the particular company. In response, the control circuitry of the game exhibits on display 34 a price quote for a share of stock in that company. The player next depresses the sell key 30 and one of the number keys 20–29 to indicate the number of shares to be sold (the zero key 29 indicating no shares). The control circuitry checks the number of shares owned by the player and signals "NOT AVAILABLE" on the display 34 if the player owns too few shares to complete the transaction.

If the player owns a sufficient number of shares to cover the number of shares being sold, the control circuitry displays the company indicator and the number of shares being sold on the private display 34. The control circuitry also adds to the player's account the cash received for the sale less a fee of approximately three percent for transacting the sale and computes the player's cash on hand.

To sell a stock short, a player selects a company by depressing one of the keys 20–27. The control circuitry causes the display 34 to exhibit the company indication and the current selling price. The player then pushes the short key 31 indicating that he desired to sell two thousand shares of the selected company short. The control circuitry automatically charges the account of the player with one half of the value of those shares at the current price and stores this amount as a deposit. The control circuitry also subtracts a one thousand dollar fee from the player's cash.

Every four rounds (approximately ten minutes in the preferred embodiment), the control circuitry causes the display 33 to exhibit an indication that "OPTIONS EXPIRE." At such time, a short sale is automatically completed, the player's deposit is returned, and the player receives two thousand multiplied by the old price minus two thousand multiplied by the present price in dollars. A short sale is also completed in the same manner when a stock splits. The player may terminate a short sale without selling and limit his loss if the price of the stock rises by pressing the key with the company indication before the "OPTIONS EXPIRE" message is presented on the display 33.

It should be noted that once a player has elected to sell a stock short he cannot trade in that stock without terminating the short sale and having the "OPTIONS EXPIRE" message appear on the display 33.

To place a call (a right to buy stock at the current price at some later date), a player pressed the option key 30 and then the selected company indication key 20–27. This causes the control circuitry to automatically place a call at the option price for three thousand shares of the selected company at a fee of three dollars per share or nine thousand dollars. The control circuitry indicates that the call transaction has been placed by causing the display 34 to exhibit the company indication followed by the words "CALL OPTION." Thereafter, the player presses the company indication key 20–27 in order to exercise the option to purchase the three thousand shares at the selected price. The call option is also exercised automatically upon a stock split. The exercise causes the player's account to increase (presuming the stock price has increased) by the difference between three thousand times the new share price minus three thousand times the option price in dollars. If a player does not exercise his option to purchase the shares, the option expires when the message "OPTIONS EXPIRE" is displayed on display 33; and the player's loss is limited to the nine thousand dollar fee initially charged for placing the call option. As with the short sale transaction, a player cannot deal in the stock for which a call has been placed until he has exercised the call option or the option has otherwise expired.

To purchase an option to "put" stock (an option to sell at a later date at a price determined at the puchase of the option), the player presses the option key 30 and the put key 31 followed by a company indication key 20–27. The control circuitry of the game automatically charges the player three dollars for each of the three thousand shares included within each put option and causes the display 34 to exhibit the company indicator followed by the words "PUT OPTION."

The player may exercise the put option by depressing the company key 20–27 before the "OPTIONS EXPIRE" message appears on display 33. At the time of exercising the option, the control circuitry credits the player's account with an amount equal to three thousand times the option price minus three thousand times the new price of the stock in dollars. As with the short sale and call options, the player cannot deal in the particular stock until the option has been either exercised or terminated. The put option terminates when the "OPTIONS EXPIRE" message appears and upon the split of a stock.

At any time during play a player may verify his holdings by depressing the verify key 29. Depressing the key 29 causes the control circuitry to cause the display 34 to show each company owned by the player followed by the number of shares in that company and the value of the holding in the particular company. The various options to purchase and sell shares in a particular company are listed without value for in computing net worth they are considered to have no value. Following the share holdings in each company and the options held to purchase or sell shares in a company is a total net worth for the player. At any time when a player's net worth is computed, if that net worth is greater than one million dollars, the control circuitry declares the player a winner and exhibits this upon the public display 33 to all players. In addition, an indication that the player has won is exhibited on the private display 34 of the winning player.

In order to borrow from the internal bank of the game, the player depresses the borrow key 31. This causes the control circuitry to run a credit check and to display on the display 34 the particular credit available for that player. As explained before, assuming no prior loans, a player has a zero line of credit when his net worth is minus one hundred thousand dollars or below; a player has a one hundred and fifty thousand dollar line of credit when his net worth is two hundred thousand dollars and above. A player's credit line varies linearly between those amounts.

After depressing the borrow key 31 and receiving an indication of the credit available to him, a player presses one of the number keys 20–29 to indicate the amount in tens of thousands of dollars he desires to borrow. The control circuitry displays 10% of this amount of display 34 as a fee, adds the total amount to the cash of the player, and subtracts the ten percent fee from the cash of the player. Thereafter, the control circuitry collects ten thousand dollars plus a ten percent fee every four rounds of quotes. At each collection, the control circuitry completes a credit check and if the loan amount outstanding exceeds the credit line available to the player, the control circuitry issues a margin call. The player must then improve his position before the next time for collection of loans or the control circuitry automatically requires a repayment of fifty thousand dollars at the next collection period. This may well cause the player to go bankrupt and lose the game. Bankruptcy of a player causes the control circuitry to display an indication that the particular player is a loser on the public display 33 and on the private display of the player losing.

A player can pay back any amount of the loan before collection time by pressing the borrow key 31, the minus key 30, and a number key 20–28 indicating the amount in ten thousands of dollars to be repaid. In such a case, the control circuitry collects no fee upon the repayment.

FIG. 3 is an illustration, partially in schematic and partially in block diagram form, of circuitry which may be utilized in a preferred embodiment of the invention shown in FIG. 1. The arrangement shown in FIG. 3 includes four keyboards 17 (designated KBD1-KBD4). Each of the keyboards may be substantially identical to that shown in FIGS. 1 and 2 above. The keyboards are interconnected by six electrical connectors 49 and are joined by those same connectors to control circuit 50. Each of the keyboards 17 is also connected to the control circuit 50 by an individual pair of lines designated 00–33. The control circuit 50 is interconnected to a control circuit 52 by a set of four conductors which connect at terminals R5 of each of the control circuits 50 and 52. The control circuits are also interconnected at their terminals D7, D8, and by a timing pulse generator circuit 54 placed between terminals OSC of each of the control circuits 50 and 52.

As will be understood by those skilled in the art, the control circuits 50 and 52 may be implemented in any of a number of different ways. However, as with many prior art electronic game circuits, the preferred embodiment of the invention utilizes integrated circuit microprocessors (miniature digital electronic computers). Such integrated circuit microprocessors are well known and include all of the input, output, memory, logic, and control circuitry of a special purpose digital computer in miniature form. In general, such circuits have both random access memory (RAM memory) and read only memory (ROM memory). The ROM memory has connections formed by masking operations during the construction of the basic circuitry of the control circuit to provide a completely wired circuit which includes the program controlling the operation of the microprocessor. Such an arrangement is often described as a dedicated memory circuit. The RAM memory of the processor is utilized for storage of the various bits of information utilized during the operation of the circuitry.

Although many electronic games known to the prior art utilize control circuitry on a single chip, the present invention utilizes two essentially similar control circuits 50 and 52 which are individually masked in such a way as to provide a substantial increase in the capability of the game over games of the prior art so that more sophisticated operations may be accomplished.

Various control circuits are offered by a number of manufacturers and are well known to the prior art. A preferred embodiment of the present invention uses two HMC-45 microprocessors manufactured by Hitachi, Ltd. The circuit for such a microprocessor is better described in the "Programmer's Reference Manual For HMCS 40 Series 4 Bit Single Chip Microcomputers" published by Hitachi, Ltd., Tokyo, Japan.

Power is applied to each of the control circuits 50 and 52 by means of a power source 56 connected through an isolating diode 58 to a DC to DC power converter 60 which provides nine volts of DC power at terminals $V_{SS}$ of control circuits 50 and 52 and at a test terminal on each of the circuits 50 and 52. An input jack 62 is provided so that alternating current may also be utilized to power the game. Each of the control circuits 50 and 52 has each of its $V_{DISP}$, $V_{DD}$, and $V_{BB}$ terminals grounded.

The output of control circuit 52 is connected at terminals $R_6$ by four electrical conductors 63 to a switching arrangement 64 which selects one of four output conductors 65 which are connected to the display 18 and control the digits display thereof. The control circuit 52 is also connected at its terminals $R_0$ through $R_3$ by means of fourteen lines 67 to a switching circuit 66 containing switches for selecting among fourteen lines 69 connecting to display 18 to control the segments display thereof.

The particular embodiment shown in FIG. 3 also has control circuit 52 connected at terminals TNTO and D to a position sensing circuit 68 which connects to the diode 58. The position sensing circuit 68 is also connected to a motor 70 which is used to drive the rotating display, all as explained in application Ser. No. 167,569 referred to above.

By operating one of the keyboards 17 in the manner described in this specification, different indications are made to appear on the display 18 in accordance with operation of the stock market game of this invention.

Figure 4A:
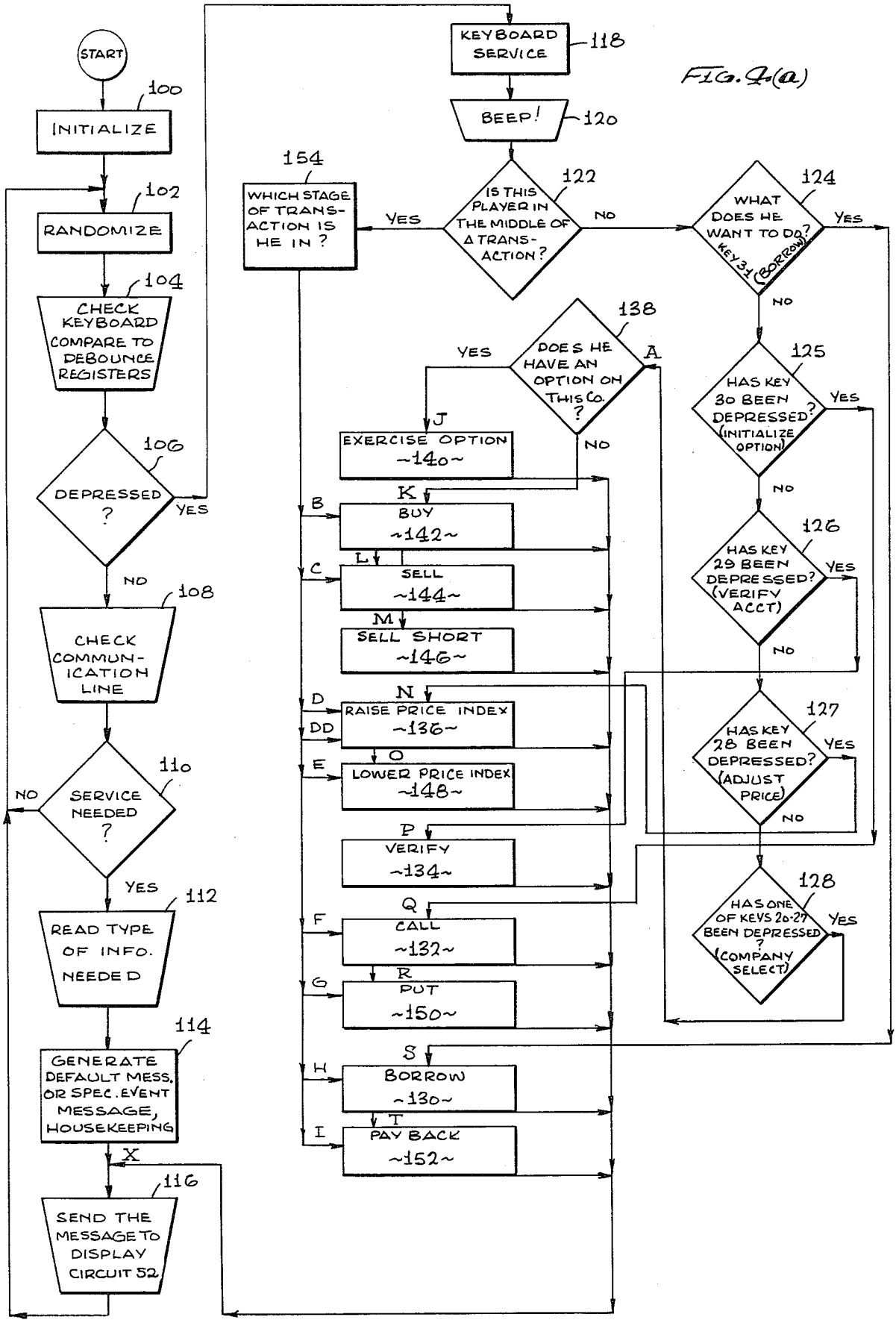
FIGS. 4(*a*)–4(*r*) are flow charts illustrating the operation of the game of this invention.
Figure 4C:
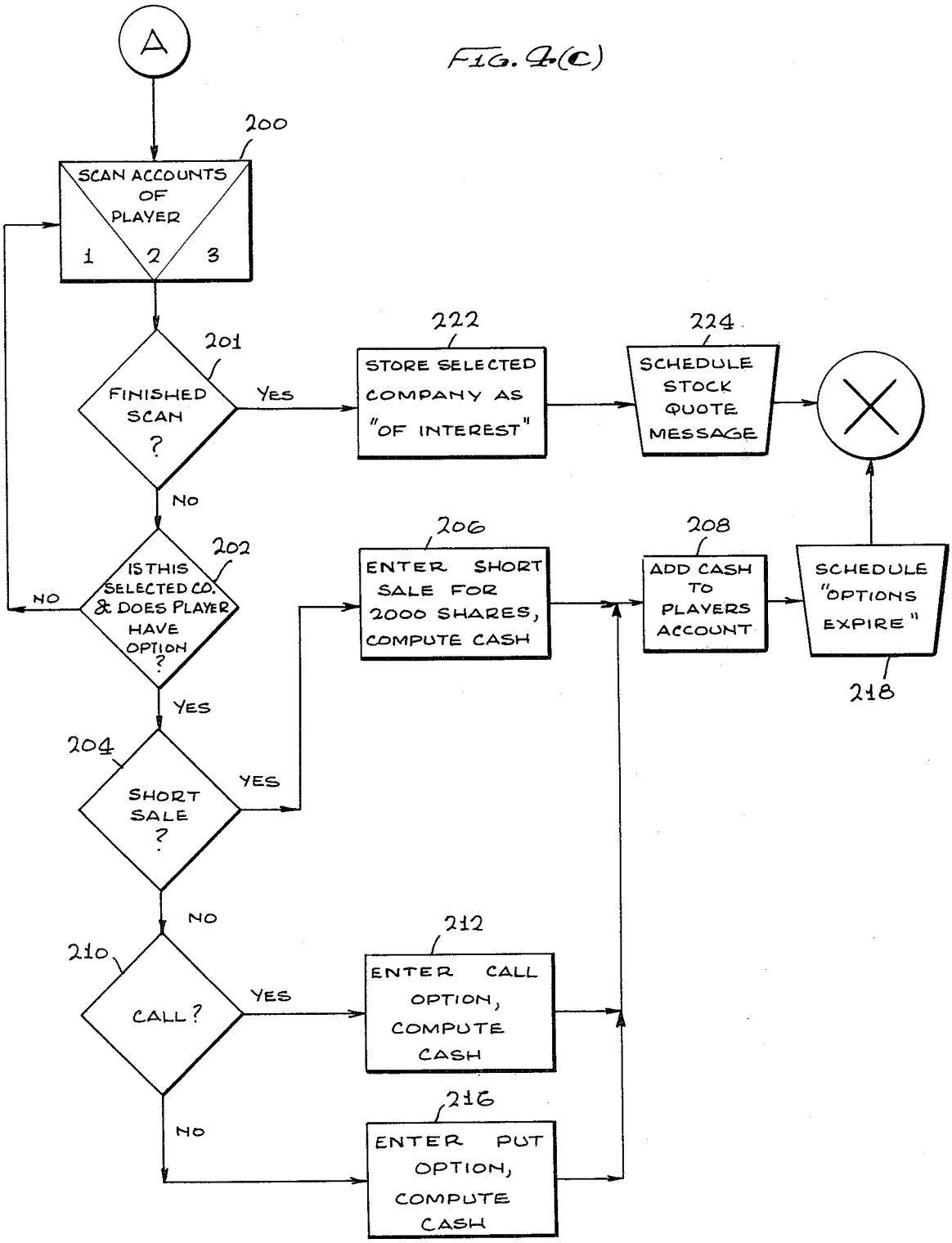
Figure 4K:
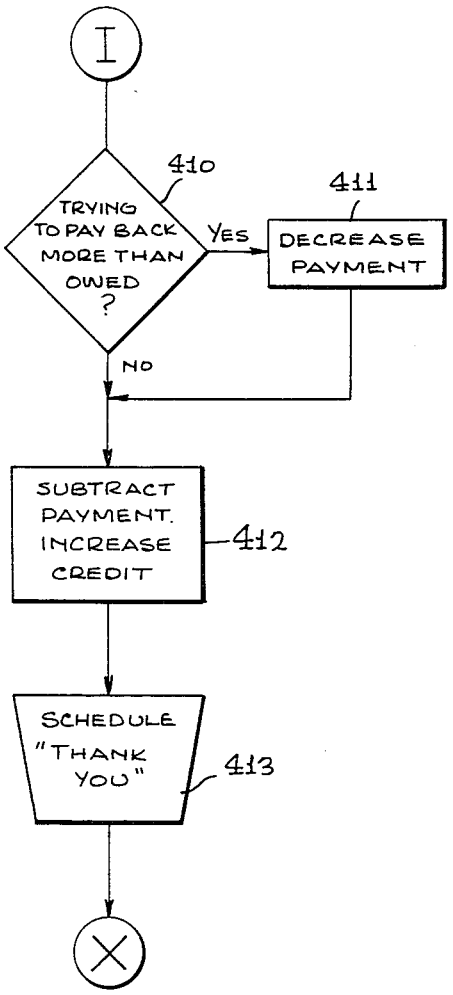
Figure 4M:
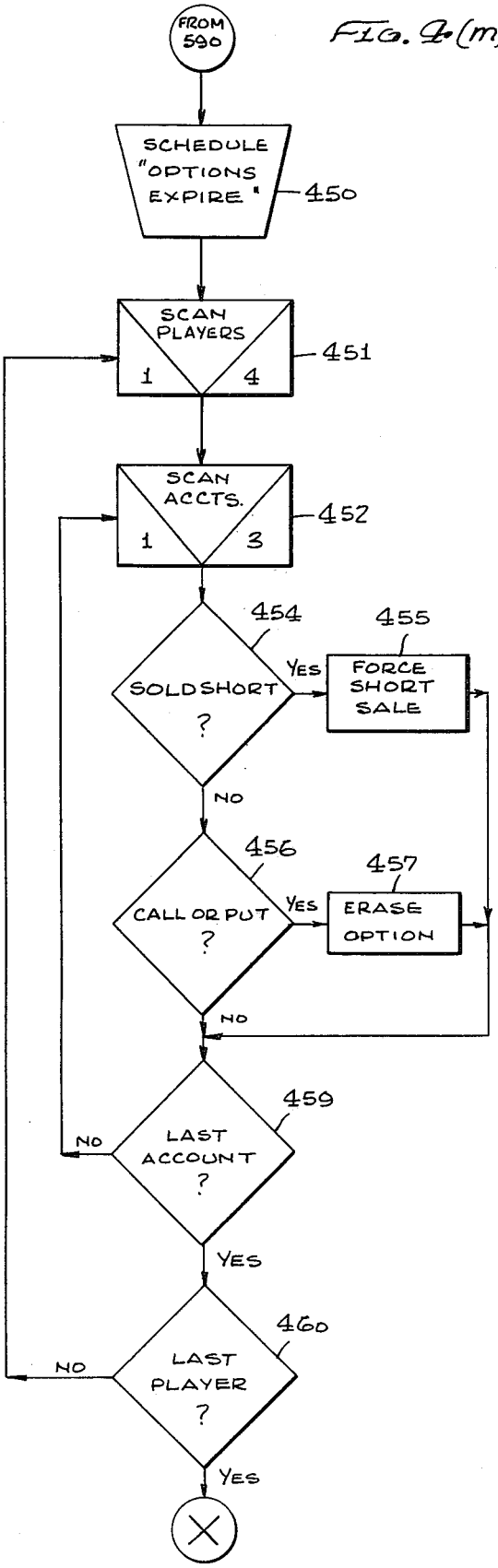
Figure 4L:
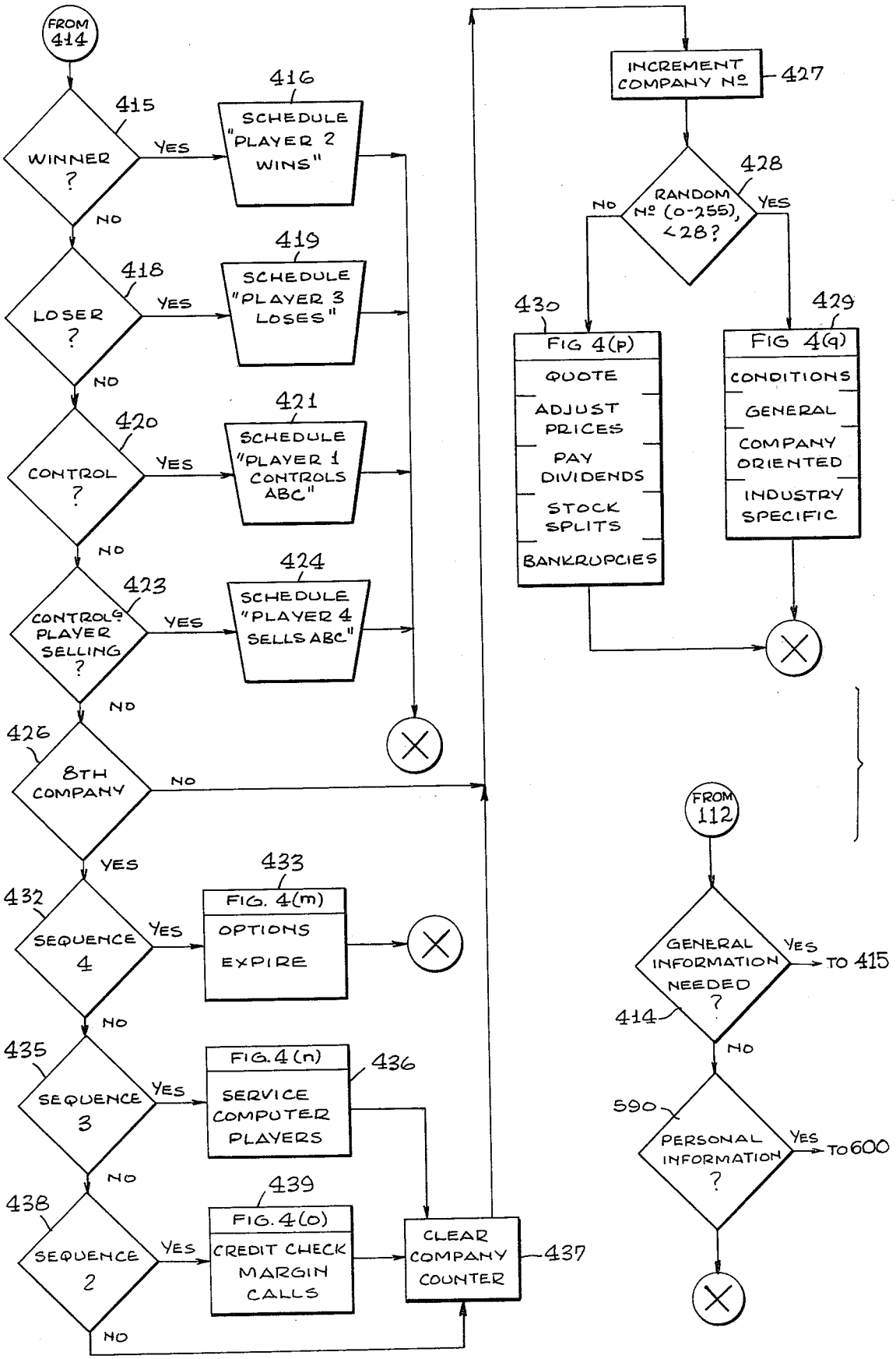
Figure 4N:
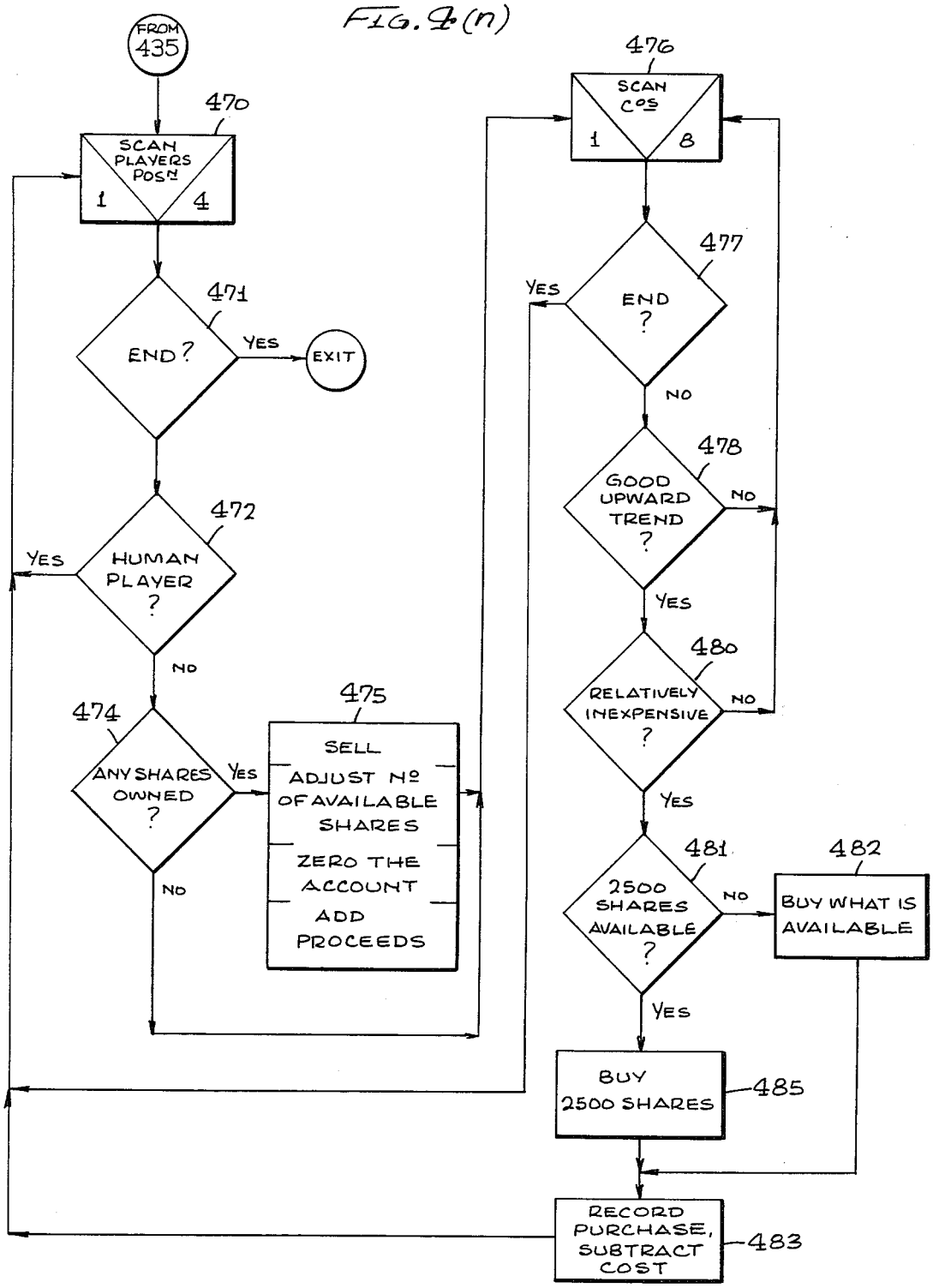
Figure 4D:
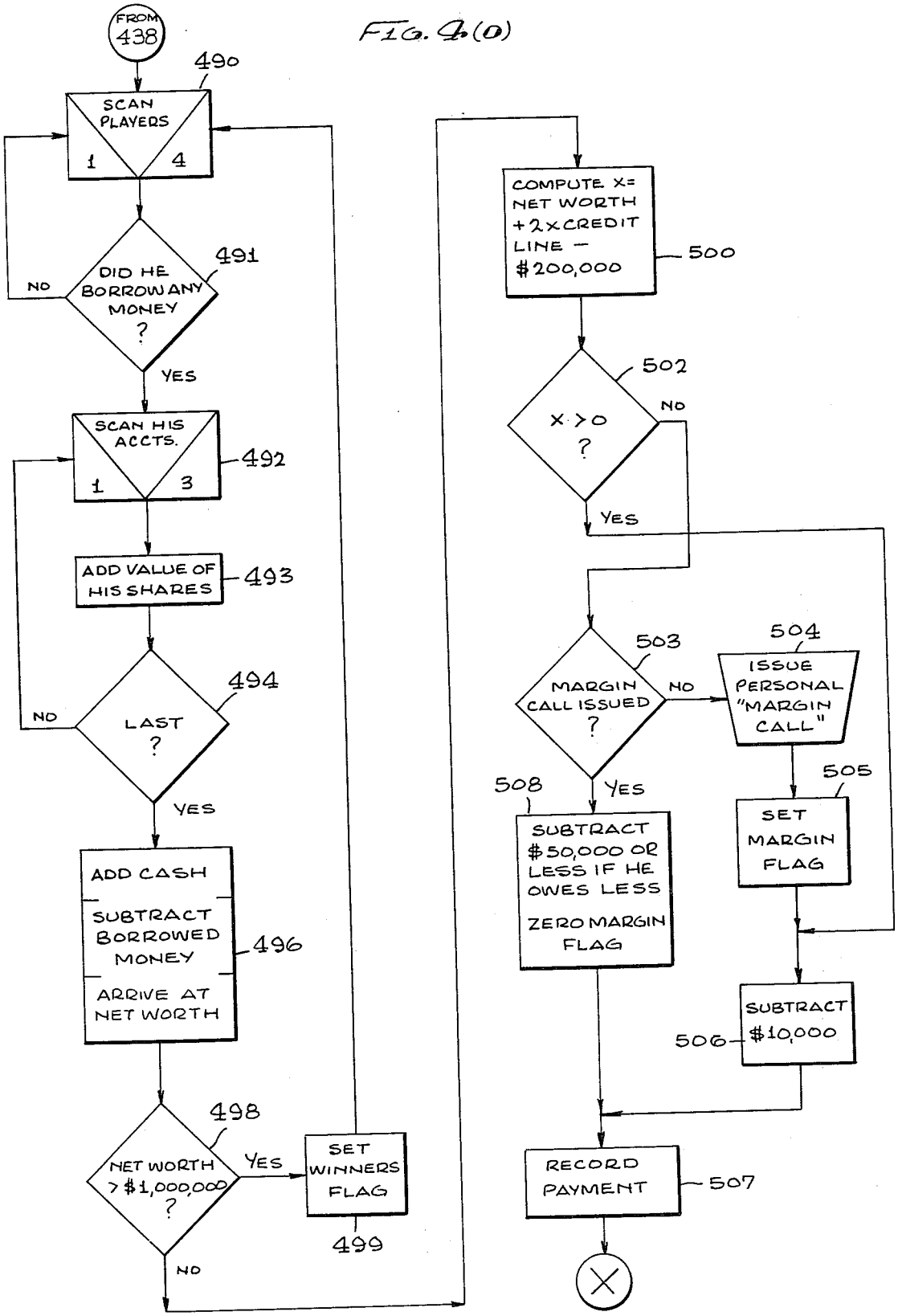
Figure 4:
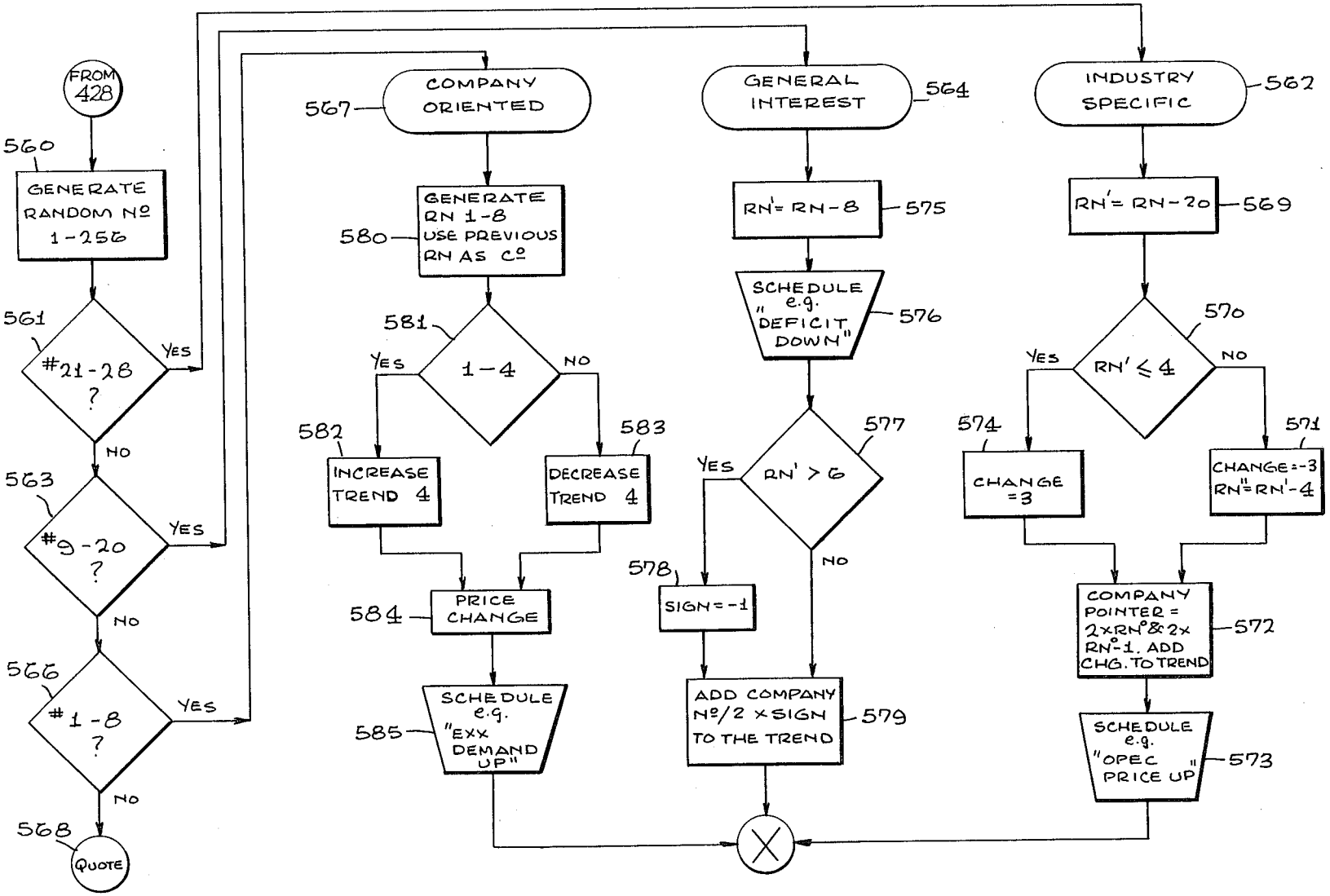
Figure 9R:
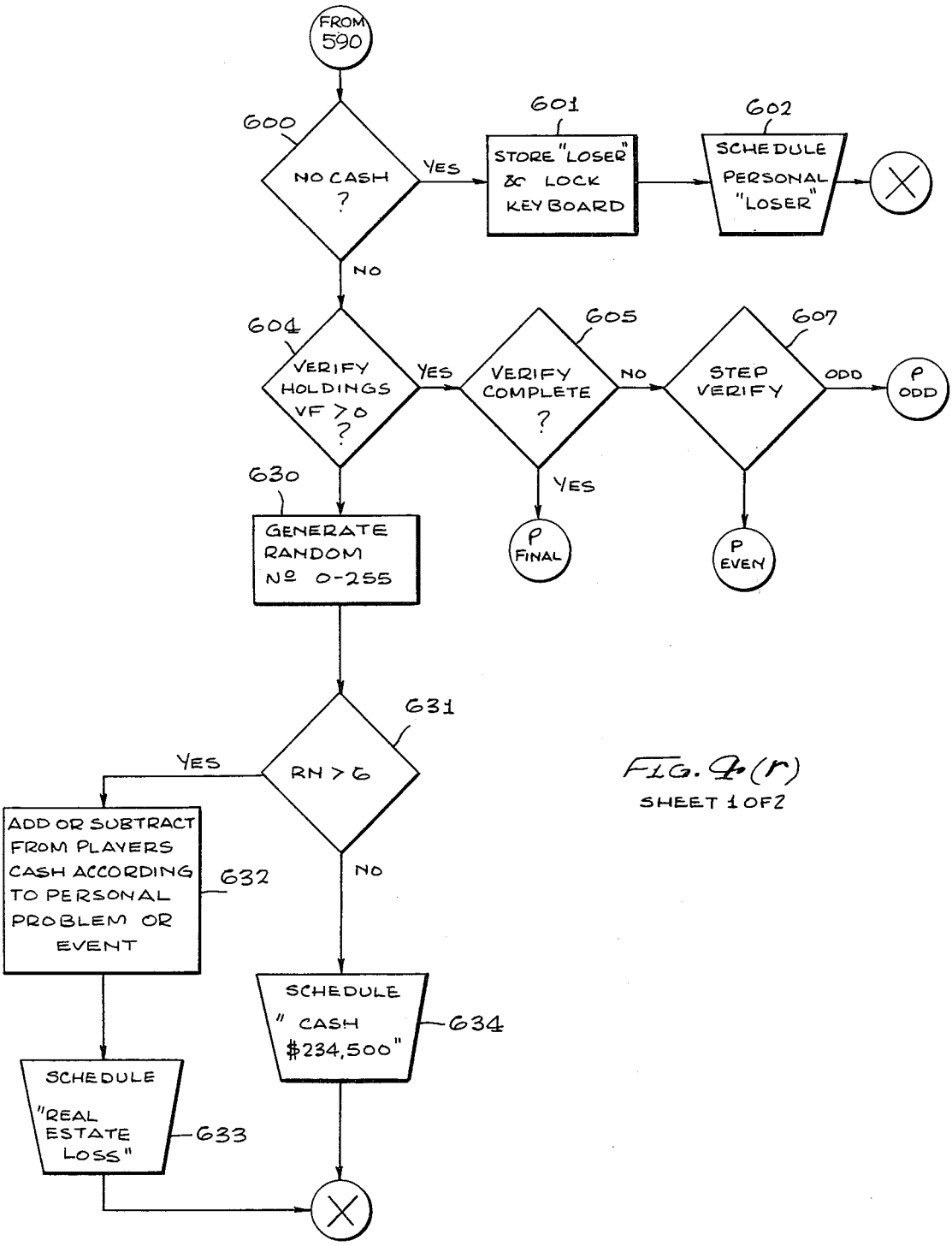
Figure 9R:
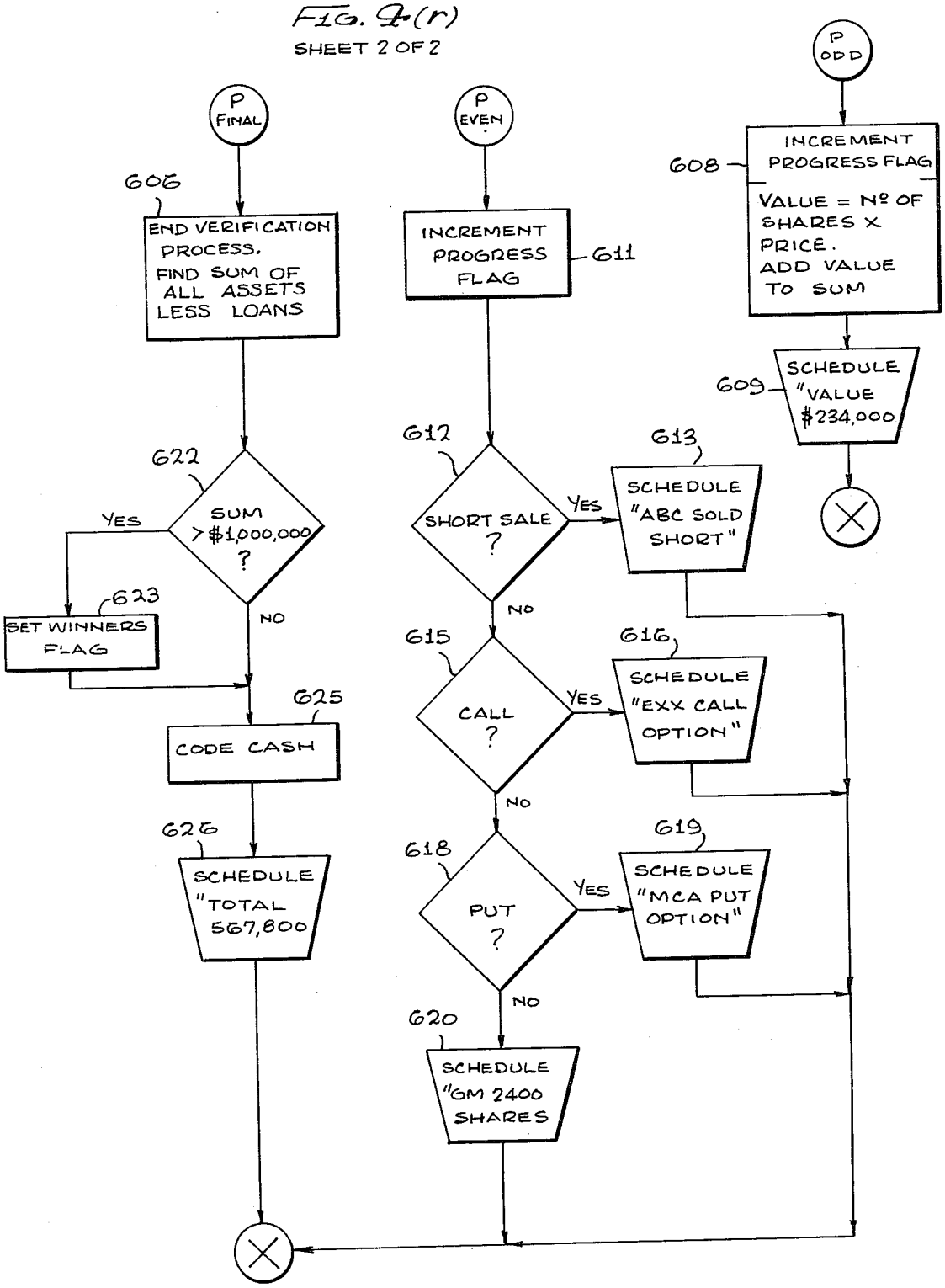

FIGS. 4(*a*)–4(*r*) together constitute a flow chart describing the overall operation of the game of this invention. FIG. 4(*a*) describes the overall operation of the microprocessors designated as circuit 50 described in FIG. 3. The circuit 50 accomplishes all computations for the game, services the keyboards 17 of the players, and controls the operation of the speaker shown in FIG. 3. The routine described by the flow chart shown in FIG. 4(*a*) is entered at step 100 at which initialization of the circuitry is accomplished. Initialization includes, among other things, setting the prices of the eight stocks to values selected at random, selecting a price trend for each stock and providing one hundred thousand dollars in cash and one hundred thousand dollars in credit to each of the player's accounts.

The program moves from step 100 to step 102 at which random numbers are generated and stored for use later in the operation of the processor 50. The program then moves to step 104 to check the status of each of the player's keyboards 17. At step 104, the status of each of the keys on the keyboard 17 is compared with its status on the last cycle of the processor 50 so that debouncing may be accomplished. The program moves from step 104 to step 106 at which a determination is made as to whether any of the keys on any of the keyboards 17 of the players have been newly depressed (depressed since the last cycle of the processor 50). If no key has been newly depressed, the program moves to step 108 to check the communication lines with the display processor circuit 52 which controls the appearance of messages on the displays 33 and 34. The program then moves to step 110 to determine whether service is required by the display processor 52. If no service is required at this point, the program recycles to step 102 and repeats the process.

If service is required by the display processor 52, the program moves to step 112 to determine the particular type of information needed by the display processor 52 and then to step 114 to generate the particular message required. From step 114, the program moves to step 116 to send the message to the display processor 52 and recycles to step 102.

If at step 106 it is determined that a particular key on a particular player's keyboard 17 has been depressed since the last cycle, the program moves to step 118 to initiate keyboard service and to step 120 to provide a beep sound at the keyboard of the player requiring the service so that he may understand that his request for service has been recognized. The program then moves to step 122 to determine whether the particular player is in the middle of a transaction. If the player is just initiating a stock market transaction, the program moves to step 124 to determine whether key 31 has been depressed indicating that the player desires to borrow. If the player does not desire to borrow at step 124, the program moves to step 125 to determine whether key 30 has been depressed indicating that the player wishes to initiate an option (put or call) transaction. If the player does not desire an option transaction at step 125, the program moves to step 126 to determine whether key 29 has been depressed indicating the player wishes to verify his account. If the player does not desire to verify his account at step 126, the program moves to step 127 to determine whether key 28 has been depressed indicating that the player wishes to adjust the price trend of a company he controls. If the player does not desire to adjust a price trend at step 127, the program moves to step 128 to determine whether one of the keys 20–27 has been depressed indicating that a company selection is being made.

From step 124, if the player desires to borrow, the program moves to step 130 to initiate the borrow subroutine. From step 125, if the player desires an option transaction, the program moves to step 132 to initiate such a transaction. From step 126, if a player wishes to verify his account, the program moves to step 134 to execute the subroutine for verifying accounts. If at step 127 the player desires to adjust the price trend of a company, the program moves to step 136 to initiate the subroutine for adjusting the price index. If at step 128 a particular company has been selected, the program moves to step 138 to determine whether the player has an option on a particular company and to step 140 to exercise the particular option. If the player has no option on the company at step 138, the program moves to step 142 to execute one of the routines for buying, selling, or selling short stock in the particular company.

From step 142 if a player desires to sell rather than buy stock, the program moves to step 144; and if the player desires to sell short rather than simply sell stock, the program moves to step 146 to execute that subroutine. As may be seen in FIG. 4(*a*), if a player desires to lower the price index at step 136 rather than raise it, the program moves to step 148 to accomplish this alternate subroutine. Furthermore, if at step 132 the player desires to place a put rather than a call, the program moves to step 150 to initiate this subroutine. Finally, if at step 130 the player desires to pay back cash already borrowed rather than to borrow new cash, the program moves to step 152 to initiate this subroutine.

If at step 122 it is found that the player is in the middle of a transaction, the program moves to step 154 to determine which stage of which transaction the player is in. From step 154 the program branches to the subroutines of steps 142, 144, 136, 148, 132, 150, 130 and 152.

After completing the subroutine of any of steps 130, 132, 134, 136, 140, 142, 144, 146, 148, 150 and 152, the program moves to step 116 at which messages regarding the particular operation taking place are sent to the display processor 52. The program they recycles to step 102.

FIG. 4(*b*) is a flow chart illustrating the steps of a subroutine for operating the display processor 52 of the invention. The subroutine is entered at step 160 at which the RAM of the processor 52 is initialized. The program then proceeds to step 162 to display information for each of the four players. From step 162, the program moves to step 164 to send information regarding the status of the display processor 52 to the master processor 50. From step 164, the program moves to step 166 to determine whether a reply has been obtained from the master processor; and, if no reply has been obtained, the program recycles to step 162. If a reply has been obtained, the program moves to step 168 to receive data from the processor 50 and to process and load the RAM of the display processor 52.

From step 168 the program moves to step 170 to determine whether the last letter of a public message is presently being displayed. If the last letter of a public message is being displayed, the program moves to step 172 to reload the public message display memory and then recycles to step 162. If at step 170, the last letter of a public message is not being displayed, the program moves to step 174 to determine whether the last letter of a private message is being displayed on display 34. If the last letter of a private message is being displayed, the program moves to step 176 to reload the memory for the private message display 34 and then recycles to step 162. If the last letter of a private message is not being displayed at step 174, the program moves to step 178 to increment the counters for both the private and public displays and then recycles to step 162.

Referring to FIG. 4(*c*), there is shown a flow chart depicting the subroutine for implementing steps 138 and 140 (shown in FIG. 4(*a*)) in a preferred embodiment of the invention. It will be recalled that a player can only conduct one transaction at a time with regard to a company. Thus, a short sale or other option transaction must be executed before another transaction can occur and the program assumes that any company indication after an option order has been entered is to exercise the option.

The subroutine is entered at step 200 at which the share accounts of the particular player are reviewed by the control circuitry. As each company is reviewed, the program moves to step 201 to see if all companies owned by or optioned to a player have been reviewed. If all companies have not been reviewed, the program moves to step 202 at which it is determined whether this company is the one selected by the player and whether options exist for this particular company. If the company scanned is not the company selected by the player or if it is the selected company but no options exist to sell short, put, or call stock of the company, the program recycles to step 200 and selects the next company owned by or optioned to the player for review.

If at step 202 it is found that with respect to the selected company an option exists, the program moves to step 204 to determine whether the option is to sell short. If the player has an option to sell short shares in this particular company, the program moves to step 206 to enter this short sale and to compute the difference between three thousand times the original price minus two thousand times the new price. The program then moves to step 208 to add this cash to the player's account, to eliminate the option in memory, and to reduce the player's account by the number of shares sold short.

If at step 204 no option for a short sale exists, the program moves to step 210 to determine whether a call option presently exists. If a call option exists, the program moves to step 212 to enter the call option and to compute the player's cash from the transaction by the difference between three thousand shares times the new price minus three thousand shares times the old price. The program moves from step 212 to step 208 explained above.

If at step 210 it is determined that no call option exists, the program moves to step 216 to enter a put option and to compute the player's cash from the transaction as the difference between three thousand shares times the old price minus three thousand shares times the new price. The program then moves to step 208.

From step 208 the program moves to step 218 at which the "OPTIONS EXPIRED" message is scheduled for presentation on a particular player's display 34. From step 218, the program exits the subroutine and returns to the routine shown in FIG. 4(*a*).

If at step 201, the scan of all companies has been completed and the selected company has not been found to be one on which an option exists, then other than an option transaction is occurring; and the program moves to step 222 to store an indication that the company selected by the player is "of interest" and to step 224 to schedule a quote for that company of the company indicator and the price at which the company is presently selling. This quote will be displayed on display 34 for the particular player. From step 224 the program exits the subroutine and returns to point X in the routine shown in FIG. 4(*a*).

FIG. 4(*d*) is a flow chart describing a subroutine for step 142 shown in FIG. 4(*a*) in a preferred embodiment for completing the buying process when it has been determined that a company is of interest at step 222 shown in FIG. 4(*c*). The subroutine is entered at step 226 at which it is determined whether the clear entry key 29 (the zero key) has been depressed or not. This key is used to cancel a transaction once it is started. If the key 29 has been depressed, the program exits the subroutine and returns to point X in the routine shown in FIG. 4(*a*). If the key 29 has not been depressed at step 226, the program moves to step 228 to determine whether the sell key 30 has been depressed. If the sell key 30 has been depressed, the program moves to step 230 to record this information in memory and then returns to the routine shown in FIG. 4(*a*).

If the sell key 30 has not been depressed at step 228, the program moves to step 232 to determine whether the short sell key 31 has been depressed. If the short sell key has been depressed, the program moves to point M in the subroutine shown in FIG. 4(*f*) to execute step 146 shown in FIG. 4(*a*).

If the short sell key 31 has not been depressed at step 232, the program moves to step 234 to scan the player's accounts and to 238 to determine whether the player can buy another company. It will be remembered that a player may deal in the stock of no more than three companies so if the player owns or has options on three companies prior to this step, the program moves to step 240 to schedule a "TOO MANY ACCOUNTS" message for the display 34 of the particular player and then returns to the routine shown in FIG. 4(*a*).

If at step 238 it is determined that the player can deal in more companies, the program moves to step 244 to determine the cash price for the particular transaction. This is equal to the number of shares times the first share price plus the fee for the transaction (the dollar amount of the purchase price divided by thirty-two to the nearest one hundred dollars).

From step 244 the program moves to step 246 to determine whether the player has enough cash for the transaction. If the player does not have enough cash, the program moves to step 248 to cause the message "NO FUNDS" to be displayed on the player's display 34 and then exits the subroutine and returns to the routine shown in FIG. 4(*a*). If the player has sufficient cash at step 246 to complete the transaction, the program moves to step 250 to determine whether enough shares of the particular stock are presently available for the transaction. If insufficient shares are available, the program moves to step 252 to schedule the message "NOT AVAILABLE" for the display 34 of the particular player and then exits the subroutine to return to the routine shown in FIG. 4(*a*).

If there are sufficient shares to complete the transaction at step 250, the program moves to step 254 to complete the transaction by decreasing the number of shares outstanding in the particular stock, raising the price of the particular stock by the transaction dollar amount multiplied by six over two hundred fifty-six thousand, increasing the player's account by the particular number of shares purchased, subtracting the cash value of the transaction from the player's cash, and recording the player's cash, and recording the player's cash-on-hand.

The program then moves to step 256 to determine whether the player owns more than half the shares of the particular company. If the player owns more than half the shares, the program moves to step 258 to schedule the announcement on the public display 33 that the particular player controls the particular company. From step 258 and from step 256 if the player owns less than half the shares of the company, the program moves to step 260 to schedule the presentation of a message that the player is buying a particular number of shares on his private display 34 and then moves to step 262 to indicate to the control circuitry that the transaction has been completed. From step 262, the program exits the subroutine and returns to the routine shown in FIG. 4(*a*).

If at step 230 of FIG. 4(*d*) a sell order has been entered, when the program reaches step 154 in the routine shown in FIG. 4(*a*), the program moves to the subroutine for implementing step 144 shown in FIG. 4(*e*). The subroutine is entered at step 270 at which a determination is made as to whether a key other than one of the keys 20–28 has been depressed. If one of these keys which is not in the sell routine has been depressed, the program exits the subroutine and returns to the routine shown in FIG. 4(*a*).

If none of these keys have been depressed, the program moves to step 272 to determine whether the player owns stock in the particular company selected. If the player does not own stock in the company selected, the program moves to step 274 to schedule the appearance of the message "NOT AVAILABLE" for display on the private display 34. The program then exits the subroutine and returns to the routine shown in FIG. 4(*a*). If the player owns stock in the selected company, the program moves to step 276 to determine whether he has a sufficient number of shares for the transaction. If he has an insufficient number of shares, the program moves to step 274 to schedule the "NOT AVAILABLE" message and exits the subroutine.

If the player has a sufficient number of shares at step 276 to complete the transaction, the program moves to step 278 to determine whether the player controls the selected company. If the player controls the company, the program moves to step 280 to schedule the presentation on the public display 33 of a message which indicates that the particular player is selling the particular stock. From step 278 if the player does not control the company and from step 280, the program moves to step 282 to complete the sell transaction by subtracting the shares sold from the player's account, adding the cash value of the transaction to the player's cash, subtracting the broker's fee from the player's cash, totaling the player's cash, lowering the stock price by the transaction value times six over two hundred fifty-six thousand, and signaling to the control circuitry that the transaction has been completed. From step 282, the program moves to step 284 to schedule a message that the player is selling a particular number of shares for display on the player's private display 34 and then exits the subroutine to return to the routine shown in FIG. 4(*a*).

FIG. 4(*f*) is a flow chart describing the operations of a preferred embodiment of the invention in accomplishing steps 132, 146 and 150 illustrated in FIG. 4(*a*). Step 132 is entered (from step 125 shown in FIG. 4(*a*)) at step 290 at which the control circuitry is caused to store an indication that the call option key 30 has been depressed. The program then exits the subroutine and returns to step 116 illustrated in FIG. 4(*a*).

Upon the next cycle of the program when it is determined at step 122 illustrated in FIG. 4(*a*) that the player is in the middle of the transaction and at step 154 that it is a transaction initiated by depressing the option key 30, the program enters the subroutine shown in FIG. 4(*f*) at step 292 at which it is determined whether the put key 31 has been depressed. If the put key 31 has been depressed, the program moves to step 294 to store that information in the memory of the control circuitry and exits the subroutine to return to step 116 of the routine shown in FIG. 4(*a*).

If the put key 31 has not been depressed at step 292, the program moves to step 296 to determine whether the zero key 29 has been depressed to indicate a cancel of the particular transaction. If so, the program exits the subroutine and returns to step 116 shown in FIG. 4(*a*). If the zero key 29 has not been depressed at step 296, the program moves to step 298 to determine whether one of the other keys which does not carry a company indicator has been depressed. If such a key has been depressed, the program moves to step 300 to schedule a message on display 34 that the entry is an "INVALID ENTRY" and exits the subroutine.

If at step 298 one of the company indication keys 20–27 has been depressed, the program moves to step 302 where it begins the "FIND" subroutine illustrated in step 304. The FIND subroutine, in essence, determines whether the player is able to deal with the stock of this company or not; and, if he may deal with the particular company, records the transaction. The subroutine is entered at step 306 at which the player's accounts are scanned. From step 306 the program moves to step 308 to determine whether the player has an interest in the particular company selected. If the player has an interest in this company, he cannot under the rules of the game register a call, put, or sell the company short, so the program moves to step 310 to schedule an invalid entry message for display on display 34 and exits the subroutine to return to the routine shown in FIG. 4(*a*).

If the player does not have an interest in the selected company at step 308, the program moves to step 312 to again scan the player's accounts and to step 314 to determine whether the player has stock or options in less than three companies and can therefore deal in this selected company. If he cannot deal in the company, the program moves to step 316 to schedule the message "TOO MANY ACCOUNTS" and exits the subroutine. If he can deal in this company, the program moves to step 318 to record the company and number of shares, the current price of the stock, and the type of option being exercised (call, put, or short sale). Where the program is entered through step 302, the call option is recorded at step 318 and the program returns to step 304 to exit the "FIND" subroutine.

The program then moves to return to the particular subroutine from which it emanated, in this case the call subroutine at step 320. From step 320, the program moves to step 322 to compute the cash effect of the transaction by subtracting a three dollar fee per share (nine thousand dollars) from the cash account of the particular player. The program then moves to step 324 to schedule the presentation of a "CALL OPTION" message on the private display 34 of the particular player and exits the subroutine to return to step 116 shown in FIG. 4(*a*).

If at step 154 (FIG. 4(*a*)) it is determined that the player is in the middle of a put transaction (the key 31 has been depressed as determined at step 292 and recorded as depressed as determined at step 294), the program enters the subroutine of FIG. 4(*f*) at a step 326 and moves immediately to the FIND subroutine at step 304. The program then moves through the FIND subroutine as explained above and returns therefrom to step 328 after having recorded the company and number of shares, the current price and that a put option is being registered (presuming that the option can be validly entered).

The program moves from step 328 to step 330 to compute the cash effect of the transaction by subtracting nine thousand dollars from the player's cash (three dollars times three thousand shares) and totaling the player's cash remaining. The program then moves to step 332 to schedule the exhibition of "PUT OPTION" on the private display 34 of the player and exits the subroutine to return to step 116 of the routine shown in FIG. 4(*a*).

If at step 232 shown in FIG. 4(*d*) it is found that the player is in the middle of a short sale transaction, the program enters the subroutine of FIG. 4(*f*) at step 334 and moves directly to the FIND subroutine step 304. The program moves through the FIND subroutine as explained above and, having recorded at step 318 the company and number of shares, the current price per share, and that the option type is a short sale (presuming a short sale is valid at this time for this player in this stock), returns to step 336. The program then moves to step 338 to compute the cash effect of the transaction by subtracting one thousand times the share price (the deposit) and a one thousand dollar fee. At step 338, the player's cash remaining is also computed; and the program moves to step 339 to schedule the "SOLD SHORT" message for display on the private display 34 for the particular player. From step 339, the program exits the subroutine and returns to step 116 as shown in FIG. 4(*a*).

FIG. 4(*g*) illustrates the subroutine for step 136 when entered from step 127 shown in FIG. 4(*a*). The program moves from step 127 to step 345 at which an indication is stored in memory that the price index is being adjusted. The program then returns to the routine shown in FIG. 4(*a*).

FIG. 4(*h*) illustrates a subroutine for steps 136 and 138 of FIG. 4(*a*) when it is determined at step 154 shown in FIG. 4(*a*) that the price index is being adjusted as recorded at step 345 in FIG. 4(*g*). It will be recalled that a player may change the price index of a company which he controls. The subroutine is entered at step 350 at which it is determined whether the player controls the particular company. If the player does not control the particular company, this indication is stored in memory at step 352 and the program moves to step 354 to schedule the presentation of the message "INVALID ENTRY" on display 34 of the particular player. The program then returns to the routine shown in FIG. 4(*a*). If the player does control the company at step 350, the program moves to step 356 to store an indication of this control and then moves to step 358 to schedule the presentation of a message showing the present price index of the particular company on the private display 34 of the particlar player. The program then exits the subroutine.

Having seen the price index of the particular company, the player may adjust the price index by depressing the adjust key 28 or first depressing the minus key 30 and then depressing the adjust key 28. When the minus key is first depressed, the program enters the subroutine at step 360 where a determination is made as to whether the minus keys has been depressed. If the key has been depressed, the program moves to step 362 to store an indication of this occurrence and then exits the subroutine. If the minus key 30 has not been depressed, the program moves to step 364 to determine whether key 29, 30, or 31 has been depressed. Since all of these keys are invalid, their depression causes the program to exit the subroutine and return to the routine shown in FIG. 4(*a*). If a number key 20–27 has been depressed at step 364, the program moves to step 366 to vary the price index of the selected company by the selected amount.

In like manner, if the minus key 30 has been depressed prior to the depression of a number key 20–27, the program ultimately enters the subroutine through a step 368 at which the depression of keys 29–31 cause the program to exit the subroutine. If a number key 20–27 has been depressed at step 368, the program moves to step 370 to indicate that a price index changes is to be made in a minus direction and then to step 366.

At step 366, the program computes the new price index for the stock in accordance with the key 20–28 depressed, then determines how far the price index originally was from the average price index and how far the new company price index is from the average price index in order to determine how much change has taken place in the difference between the average price index and the price index of the company. At step 366 the price trend for the company is also varied with the change (one dollar price plus or minus change in the price trend for the company for each dollar by which the price index is closer to or farther from, respectively, the average of the price indexes). In order to provide a more difficults game, step 366 also adjusts the price indices of each of the individual companies down by one point if the average is above ten sfor the companies and up by one point if the company average is below five. Such an adjustment makes it more difficult for all of the players to follow the trends. From step 366, the program moves to step 358 to schedule the appearance of a message announcing the new price index for the company on the private display 34 of the particular player and exits the subroutine to return to step 116 shown in FIG. 4(*a*).

If a player wishes to borrow from the bank, the program moves from step 124 shown in FIG. 4(*a*) to the subroutine of steps 130 and 152. These are shown in FIGS. 4(*i*),4(*j*) and 4(*k*). The initial subroutine is shown in FIG. 4(*i*) in which the program moves from step 124 to step 380 to store in memory an indication that the borrow key 31 has been depressed. The program then moves to step 382 to establishd the credit line presently available for the player as equal to the player's cash on hand plus the value of his shares minus any loans already outstanding to the player. The program then moves to step 383 to determine whether the net worth of the player is greater than a million dollars. If the player's net worth is over a million dollars, the program moves to step 384 to store an indication that the player is a winner of the game. From steps 384 and from step 383 if the player's net worth is less than a million dollars, the program proceeds to step 386 to determine whether the credit presently available (maximum credit available minus any loans outstanding) is greater than one hundred fifty thousand dollars. Since this is the maximum credit line, if it is exceeded the program moves to step 388 to establish the credit line at one hundred fifty thousand dollars minus loans outstanding.

From step 388 and from step 386 if the credit maximum limit is not exceeded, the program moves to step 389 to determine whether the credit line of the player is less than zero. If the credit line of the player is less than zero, the program moves to step 390 to establish the credit line at zero. From step 390 and from step 389 if the credit line is not less than zero, the program moves to step 391 to schedule a message indicative of the credit presently available to the player. From step 391 the program returns to step 116 shown in FIG. 4(*a*).

On the next iteration of the control circuitry, presuming that the borrow transaction is occurring, the programs returns to the subroutine shown in FIG. 4(*j*) at step 400 where it is determined whether the minus key 30 has been depressed. If the minus key 30 has been depressed, a payback of a debt is in progress; and the program moves to step 401 to store an indication of this and then returns to step 116 shown in FIG. 4(*a*). If the minus key 30 has not been depressed at step 400 the program moves to step 402 to determine whether the clear entry key 29 has been depressed. If the key 29 has been depressed, the program returns to step 116 of FIG. 4(*a*).

If at step 402 the clear entry key 29 has not been depressed, the program moves to step 404 to determine whether the player has requested to borrow more than the credit line established at step 391 shown in FIG. 4(*i*). If the player has requested more than his credit line, the program moves to step 406 to schedule the message "INVALID ENTRY" and returns to step 116 shown in FIG. 4(*a*). If at step 404 the player has not requested more than his credit line, the program moves to step 407 to add ninety percent of the loan to the player's cash, to decrease the player's credit available by the loan amount, and to total the amount of the player's cash-on-hand. From step 407, the program moves to step 408 to schedule the appearance of a message stating the fee for the transaction on the particular player's private display 34. The program then returns to step 116 shown in FIG. 4(*a*).

The subroutine for the payback of a loan in step 152 of FIG. 4(*a*) is shown in FIG. 4(*k*). The subroutine is entered at step 410 at which a determination is made as to whether the player is trying to pay back more than he owes. If the player is trying to pay back an overage, the amount is decreased at step 411 to the amount actually owed by the player. From step 411 and from step 410 if the player is not trying to pay back more than he owes, the program moves to step 412 to subtract the payment from the amount owed and to increase the player's credit available. The program then moves to step 413 to schedule the message "THANK YOU" for the player's private display 34 and returns to step 116 shown in FIG. 4(*a*).

FIG. 4(*l*) illustrates a subroutine for accomplishing the generation of messages included in step 114 of FIG. 4(*a*). The subroutine is entered at step 414 at which it is determined whether general information is needed. If general information is needed, the program moves to step 415 to determine whether a winner is to be declared. If a winner has been found, the program moves to step 416 to schedule a message that a particular player has won the game. From step 416, the program returns to step 116 shown in FIG. 4(*a*).

If at step 415 a winner is not to be declared, the program moves to step 418 to determine whether a loser is to be declared. If a loser has been determined, the program moves to step 419 to schedule the message that a particular player has lost for display on display 33 of all player's consoles. From step 419, the program returns to step 116 shown in FIG. 4(*a*).

If at step 418 a loser is not to be declared, the program moves to step 420 to determine if a player has just gained control of a company. If a player has just acquired control of a company, the program moves to step 421 to schedule a message for the public display 33 that a particular player controls a particular company. The program then returns to step 116 of FIG. 4(*a*).

If at step 420 no player has just gained control of a company, the program moves to step 423 to determine whether a player who controls a company is presently selling shares in that company. If a controlling player is selling shares in the controlled company, the programs moves to step 424 to make a public announcement of this fact on display 33; and the program then returns to step 116 shown in FIG. 4(*a*).

If at step 423 a controlling player is not selling in a controlled company, the program moves to step 426 to determine whether an entire sequence of eight companies and their share prices have been displayed. If eight companies have not yet been displayed (that is, a round of companies has not yet been shown on the public displays 33), the program moves to step 427 to increment the count of the companies which have been displayed and to step 428 to generate a random number between zero and two hundred and fifty-five.

If a step 428 the random number is less than twenty-eight (in approximately one out of ten cases), the program moves to step 429 to generate messages regarding particular companies, particular industries, or of general interest to all of the players. The program moves from step 429 to step 116 shown in FIG. 4(*a*). If at step 428 the random number selected is greater than 28 (in approximately nine out of ten cases), the program moves to step 430 at which quotes are generated, share prices are adjusted, dividends are paid, stocks are split, and bankruptcies are declared. From step 430, the program returns to step 116 shown in FIG. 4(*a*).

If at step 426 the round of companies has been completed, the program moves to determine whether this is the fourth sequence of company quotes. Each sequence of eight company quotes is given a number of from one through four. On every fourth sequence options expire. Consequently, the program moves from step 432 to step 433 to cause the various options to expire and then returns to step 116 shown in FIG. 4(*a*). If at step 432 the sequence is not four, the program moves to step 435 to determine whether this is the third sequence of companies. If this is the third sequence of companies, the program moves to step 436 to simulate players at the unfilled console stations. From step 436, the program moves to step 437 to reset the sequence of companies to be quoted and then moves to step 427.

If at step 435 the sequence is not three, the program moves to step 438 to determine whether this is the second sequence of companies. If this is the second sequence of companies, the program moves to step 439 to run credit checks on the players and issue margin calls and then moves to step 437 to set the company being counted to zero. If at step 438 this is not the second sequence, the program moves directly to step 437.

The subroutine for step 433 of FIG. 4(*l*) in which options expire is shown in FIG. 4(*m*). The subroutine is entered at step 450 at which the message "OPTIONS EXPIRE" is scheduled for display. From step 450, the program moves to step 451 to scan each of the players. As each player is scanned, the program moves to step 452 to scan the stocks owned by that player and the options which that player holds. From step 452 the program moves to step 454 to determine whether any stock is sold short. If a stock is sold short, the program moves to step 455 to force a short sale of that stock. If a stock is not sold short at step 454, the program moves to step 456 to determine whether the player has either a put or a call on the particular stock. If a player has a put or call on a stock, the program moves to step 457 to eliminate that option. From steps 455, 457, and 456 (if the player does not have a put or call on a particular stock), the program moves to step 459 to determine whether this is the last account of the player to be reviewed. If this is not the last stock held by the player or upon which the player has an option, the program returns to step 452 to scan the remaining accounts of the player.

If this is the last account of the player, the program moves to step 460 to determine if this is the last player to be reviewed. If this is not the last player to be reviewed, the program moves to step 451 to scan the other players and their accounts. When the last account of the last player has been scanned, the program returns to step 116 shown in FIG. 4(*a*).

The subroutine of step 436 for simulating players at consoles which are not occupied by human players is shown in FIG. 4(*n*). The subroutine is entered at step 470 at which each of the player positions is scanned. The program moves next to step 471 to determine whether all four player positions have been scanned. If all four player positions have been scanned, the program exits the subroutine and moves to step 437 shown in FIG. 4(*l*). If at step 471 all player positions have not been scanned, the program moves to step 472 to determine whether a human player occupies the position. This is determined by determining whether one of the keys on the keyboard 17 at that position has been depressed to indicate that a human occupies that position. If a human player occupies the position, the program recycles to step 470 to scan the other player positions.

If a human player does not occupy the position at step 472, the program moves to step 474 to determine whether the simulated player owns any shares. If the player owns shares of stock in a company, the program moves to step 475 to sell those shares, to adjust the number of available shares on the market, to zero the share account of the player position, and to add the proceeds to the cash-on-hand at the player position. The program then moves to step 476 to scan all of the companies. If at step 474 the player owns no shares in a company, the program moves directly to step 476.

As each company is scanned, the program moves from step 476 to step 477 to determine whether all companies have been scanned. Once all companies have been scanned, the program returns to step 470 to continue the scan of player positions. Before completion of the scan at step 477, the program moves to step 478 to determine whether the particular company being scanned has an upward price trend greater than or equal to five. If it does not have a trend of five or greater, the program returns to step 476 to pick another company. If the program at step 476 determines that the company selected has a good upward price trend, the program moves to step 480 to determine whether the price of that company is relatively inexpensive (less than thirty dollars per share). If the company is not relatively inexpensive, the program moves to step 476 to select another company.

If at step 480 the company being scanned is found to be relatively inexpensive, the program moves to step 481 to determine whether twenty-five hundred shares of the company are available. If less than twenty-five hundred shares are available, the program moves to step 482 to buy all shares available and then to step 483 to record the purchase and subtract the transaction cost from the player's accounts. If at step 481 twenty-five hundred shares are available, the program moves to step 485 to buy twenty-five hundred shares and then to step 483 to record the purchase and subtract the cost from the player's account. The program then recycles to step 470.

FIG. 4(*o*) illustrates a flow chart for the subroutine of step 439 shown in FIG. (*l*) in which credit checks and margin calls are accomplished. The subroutine is entered at step 490 at which each player is scanned. As each player is scanned the program moves to step 491 to determine whether that player has borrowed any money. If at step 491 it is found that the player borrowed to money, the program moves back to step 490 to scan the next player. If at step 491 a player is found to have borrowed money, the program moves to step 492 to scan the stock accounts of the player and to step 493 to add the value of this shares. From step 493 the program moves to step 494 to determine whether this is the last account of the particular player and, if not, returns to step 492 to scan the remaining accounts.

If this is the player's last account, the program moves to step 496 to add the player's cash to the value of his shares, subtract the money borrowed by the player, and arrive at his net worth. From step 496 the program moves to step 498 to determine whether the player's net worth is greater than a million dollars. if the player's not worth is greater than a million dollars, the program moves to steps 499 to store an indication that the player is a winner and returns to step 490 to scan the other players.

If at step 498 the net worth of the particular player is less than a million dollars, the programs moves to step 500 to compute a value to determine whether a margin call should be issued (value=net worth+2X (credit line)—$200,000). From step 500 the program moves to step 502 to determine whether the value computed is greater than zero. If the value computed is not greater than zero, the program moves to step 503 to determine whether a margin call has already been issued for the player. If a margin call has not been issued, the program moves to step 504 to issue a margin call and to step 505 to store an indication that a margin call has been issued. The program then moves to step 506 to subtract ten thousand dollars from the player's cash and to step 507 to record the amount subtracted.

If at step 503 a margin call has already been issued to the player, the program moves to step 508 to subtract fifty thousand dollars from the player's cash (or less if the player owes less) and to eliminate the indication in the memory of the control circuitry that a margin call has been given to the player. From step 508 the program moves to step 507 to record the payment by the player. From step 507 the program returns to step 437 shown in FIG. 4(*l*).

If a step 502 the player's net worth is greater than zero, the program moves directly to step 506 without issuing a margin call.

FIG. 4(*p*) is a flow chart illustrating a subroutine for carrying out the details of step 430 shown in FIG. 4(*l*). The subroutine is entered at step 510 at which random numbers having a value from minus to plus three are generated and added at random to the price trend for each company. The sum of the random number and the trend value is limited to a range of minus to plus seven and is added or subtracted from the company price. The effect of step 510 is to cause the stock to move up or down in accordance with its price trend with a random variation about the center of the price trend.

The program moves from step 510 to step 511 at which it is determined whether the new price of the stock is sixty-three dollars. If the new price of the stock is exactly sixty-three dollars, the stock is split; and the program moves to step 512 to scan the accounts of each player to determine whether he owns or has options for stock of the particular company. For each stock scanned for each player, the program moves to step 513 to determine if this is the company of interest having a price of sixty-three dollars. If the company is incorrect, the program recycles to look at the next stock of the player. If at step 513 a player is found to have an interest in the company, the program moves to step 515 to determine if the player owns the company. If the player owns stock in the company, the program moves to step 516 to give the player thirty dollars times the number of shares in which he owns and then moves to step 517 to determine if this is the last account of the player. If this is not the last account, the program recycles to step 512.

Ultimtely, the program moves to step 518 to determine whether this is the last player; and, upon finding the last player, moves to step 519 to set the new price of the stock at thirty dollars, to step 520 to schedule the appearance of a message on the public display 33 that the particular company has been split and then returns to step 116 shown in FIG. 4(*a*).

If at step 515 the player does not own the company being split, the program moves to step 522 to determine whether the player has sold the company short. If the player has sold the company short, the program moves to step 523 to execute the short sale. If the player has not sold the company short at step 522, the program moves to step 524 to determine whether the player has a call for the company which is being split. If the player has a call for the company being presently reviewed, this call is exercised at step 525. If the player does not have a call for the company, the program moves to step 526 to determine whether the player has a put option for stock of the company. If the player has a put option, the program moves to step 527 to cancel the put. From each of steps 516, 523, 525 and 527 the program moves to step 517.

If at step 511 the price of a particular company is not exactly sixty-three dollars, the program moves to step 529 to determine whether the price of the company is equal to or less than zero. If the price of the company is equal to or less than zero, the company is bankrupt and the program moves to step 530 to set up a bankruptcy. From step 530, the program moves to step 531 to create a new company under the old name, to set the price of the new company at the old price plus ten dollars, and to set the price trend of the new company at the old price trend plus three points. This creates a cheap stock having what is probably a positive price trend. The program then moves to step 532 to schedule the appearance of a message on the public display 33 that the old company is bankrupt.

From step 532, the program moves to step 533 to scan the stock accounts of the players one by one. The program moves from step 533 for each share of each player to step 534 to determine if the player owns shares in the bankrupt company. If the player owns shares, the accounts for those shares are zeroed (given a value of zero) at step 535. If the player does not own shares in the particular company, the program moves to step 536 to determine if the player has sold the shares short. If the player has sold the shares short, the program moves to step 537 to execute the short sale.

If the player has not sold the shares short at step 536, the program moves to step 538 to determine whether the player has a call on the stock of the bankrupt corporation. If the player has a call, the program moves to step 539 to cancel the call. If no call has been posted at step 538, the program moves to step 541 to determine whether the player has a put for the bankrupt stock. If the player has a put, the program moves to step 542 to exercise the put.

From steps 535, 537, 539, 542, and 541 (if the player has no put), the program moves to step 544 to determine whether this is the last account of the particular player being reviewed. If not, the program returns to step 533 to complete the review of all accounts for that particular player. If at step 544 this is the last account of the particular player, the program moves to step 546 to determine whether this is the last player to be reviewed. If this is not the last player, the program returns to step 533 to scan the remainder of the players. If at step 546 the last player has been reviewed, the program exits the subroutine and returns to step 116 shown in FIG. 4(*a*).

If at step 529 the price of the company is greater than zero, the program moves to step 550 to determine whether the price is over sixty dollars. If the price of the company is over sixty dollars, the program moves to step 551 to set a new trend for the stock at the old trend plus the excess by which the stock exceeds sixty minus five points. A new price for the stock is also set at the old price plus the new trend. From step 550 if the price is less than sixty dollars and from step 551, the program moves to step 552 to generate a dividend of zero or one dollar if the price is less than thirty for the stock and of one or two dollars if the price is greater than or equal to thirty dollars for the stock. At step 552 also, this dividend is paid to the players. The program then moves to step 553 to schedule the appearance of a message on the display 33 declaring the dividend and listing the new price of the stock. From step 553 the program returns to step 116 shown in FIG. 4(*a*).

FIG. 4(*g*) is a flow chart illustrating the details of a preferred embodiment of step 429 shown in FIG. 4(*l*) during which various condition messages are generated for display on the display 33. The subroutine is entered at step 560 at which a random number between one and five hundred twenty-six is generated. From step 560 the program proceeds to step 561 at which it is determined whether the number falls between twenty-one and twenty-eight (in one out of thirty-two cases). If the number falls between twenty-one and twenty-eight, the program moves to step 562 to provide an industry specific message. If the random number does not lie between twenty-one and twenty-eight at step 561, the program moves to step 563 to determine whether the number lies between nine and twenty. In the approximately three out of sixty-four cases in which the random number lies between nine and twenty, the program moves to step 564 to generate a general interest message. If the random number does not lie between nine and twenty at step 563, the program moves to step 566 to determine whether the number lies between one and eight. In the one case out of thirty-two in which the number lies between one and eight, the program moves to step 567 to generate a company oriented message. If the random number generated is not from one to twenty-eight (i.e., approximately ninety percent of the time), the program moves to step 568 to generate a company stock quote.

In generating an industry specific message, the program moves from step 562 to step 569 to subtract twenty from the random number and to step 570 to determine whether the new random number is less than or equal to four. If the random number generated is greater than four, the program moves to step 571 to cause a change in the price trend of the particular industry by minus three and to subtract four from the new random number. The program then moves to step 572 to pick the individual companies in the industry and change their price trends by the minus three points. To accomplish this, each company is given a number from one to eight with companies having adjacent numbers being in the same industry. The number realized at step 572 is multiplied by two at step 572 to get one company in the industry, and one is subtracted from the result to get the other company. The price trend of each company is then reduced by three.

From step 572 the program moves to step 573 to generate a negative industry specific message, and then returns to step 116 shown in FIG. 4(*a*).

If at step 570 the random number is equal to or less than four, the program moves to step 574 to generate a positive change of three in trend of the particular companies in the industry and then moves to step 572 to determine the companies (as explained above) and to step 573 to generate a positive message.

In generating a general interest message, the program moves from step 564 to step 575 at which eight is subtracted from the random number generated. This number is used to select a message which affects all companies at step 576. The program then moves to step 577 to determine whether the random number selected less eight is greater than six. If the number is greater than six (in half the cases), the program moves to step 578 to generate a sign change of minus one and on to step 579. At step 579 the company number (see step 572) is divided by two and multiplied by minus one to determine a change in the trend for the particular company with negative messages. The program moves to step 579 from step 577 if the random number is six or less and the message is positive so that a positive change is added to the trend of each company. From step 579, the program returns to step 116 shown in FIG. 4(*a*).

In generating a company oriented message, the program moves from step 567 to step 580 to generate a new random number between one and eight. The program then moves to step 581 to determine whether the new random number generated is between one and four. If the random number is between one and four (in half the cases), the program moves to step 582 to increase the company price trend by four. If the random number is greater than four, the program moves to step 583 to decrease the company price trend by four. From steps 582 and 583, the program moves to step 584 to institute the price change in the company stock and to step 585 to schedule the appearance of a message which is company specific and is related to the increase or the decrease in the company stock. The program then moves to step 116 shown in FIG. 4(*a*).

If at step 414 shown in FIG. 4(*l*), general information is not needed, the program moves to step 590 to determine whether a personal information message should be generated. If such a message is not required, the program returns to step 116 shown in FIG. 4(*a*). If a personal information message is required, the program moves to step 600 of a subroutine shown in FIG. 4(*r*).

FIG. 4(*r*) shows a flow chart for a subroutine used in the preferred embodiment for implementing the individual message generation. The subroutine commences at step 600 at which a determination is made as to whether the particular player has any cash. If the player has no cash, the program moves to step 601 to store in memory an indication that the player is a "loser" and to lock the player's keyboard 17 so that it cannot be used thereafter. From step 601, the program proceeds to step 602 to schedule a message that the particular player is a "loser." The program then recycles to step 116 shown in FIG. 4(*a*).

If at step 600 the player has cash, the program moves to step 604 to verify that the player's net worth is greater than zero. If the player's net worth is greater than zero, the program moves to step 605 to determine whether the verification process has been completed. If the process has been completed, the program moves to step 606 at which the total of all the assets owned by the player is computed.

If the verify process is not complete at step 605, the program moves to step 607 at which a determination is made as to what step in the verify process is taking place. The program alternates between a step in which it determines whether options exist for particular shares and a summing of the value of shares owned. In odd steps, a summing takes place and, in this case, the program moves from step 607 to step 608 at which the progress through the verification process is incremented by one step and a value of a particular company's shares is computed by multiplying the price per share times the number of shares held. This value is added to the sum and the program moves to step 609 to schedule the presentation of a message that the player owns a particular number of shares which have a value of a particular amount. The program then returns to step 116 shown in FIG. 4(*a*).

If at step 607 the even steps of the verify process are involved, the program moves to step 611 to again increment the progress through the verification process and then to step 612 to determine whether a short sale in a particular stock is outstanding. If a short sale is outstanding, the program moves to step 613 to schedule a message such as "ABC SOLD SHORT" and then returns to step 116 shown in FIG. 4(*a*).

If at step 612 no option to sell short exists, the program moves to step 615 to determine whether a call option exists. If a call option exists, the program moves to step 616 to schedule the presentation of a message that such a call option exists for a particular stock and then returns to step 116 shown in FIG. 4(*a*). If at step 615 a call option does not exist, the program moves to step 618 to determine whether a put exists. If a put exists at step 618, the program moves to step 619 to schedule the presentation of a message that a particular put exists. From step 619 the program recycles to step 116 shown in FIG. 4(*a*). If at step 618 no put option is outstanding, the program moves to step 620 to schedule the presentation of a message regarding the particular company owned and the number of shares owned. The program recycles to step 112 shown in FIG. 4(*a*).

At step 606 (mentioned above) at which the verification process is completed and the totals summed for the particular player, the program moves to step 622 at which it is determined whether the sum of the player's net worth is greater than one million dollars. If the sum is greater than one million dollars, the program moves to step 623 to store an indication that the player is a winner. From step 623 and from step 622 if the player's net worth is less than one million dollars, the program moves to step 625 to store the total of cash owned by the player and to step 626 to schedule a presentation of a message regarding the total net worth of the player. The program then returns to step 116 shown in FIG. 4(*a*).

If at step 604 mentioned above, a verification of holdings is not required, the program moves to step 630 to generate a random number from zero to two hundred fifty-five. From step 630, the program moves to step 631 to determine whether that random number is less than six. If the random number is less than six (in approximately one out of forty-three cases), a personal message such as "REAL ESTATE LOSS" occurs and cash is added to or subtracted from the player's account. In such a case, the program moves to step 632 to add or subtract from the player's cash according to the personal event generated and then moves to step 633 to schedule the presentation of the message regarding the particular personal event. If the random number is not less than six, the program moves to step 634 to schedule the presentation of a message regarding the particular player's cash holdings. From step 633 and step 634, the program returns to step 116 shown in FIG. 4(*a*).

As will be understood by those skilled in the art, many different programs may be utilized to implement the flow charts disclosed in this specification. Obviously, those programs will vary from one another in different degrees. However, it is well within the skill of the art of the computer programmer to provide particular programs for implementing each of the steps of the flow charts disclosed herein. It is also to be understood that various microcomputer circuits might be programmed for implementing each of the steps of the flow charts disclosed herein without departing from the teaching of the invention. It is therefore to be understood that, because various other embodiments may be devised by those skilled in the art without departing from the spirit and scope of the invention, it is the intention of the inventors to be limited only by the scope of the claims appended hereto.

What is claimed is:

1. A market game comprising at least two player positions each including display means for simulating a stock market terminal, control circuit means adapted to cause the display to indicate stocks available in the game and the prices thereof, and input means associated with each player position for signaling the control circuit means to purchase and sell shares of stock available, and in which the control circuit means includes means for automatically detecting whether a player position is occupied, including means for determining whether the input means associated with that player position has been actuated, and means for automatically simulating the play of a human player at any position at which the associated input means has not been actuated.

2. A market game comprising at least two player positions each including public display means for indicating public information at all player positions, and each including private display means viewable only at its particular player position for selectively indicating information which is confidential to that particular player; input means associated with each player position for designating a market transaction; transaction control means responsive to the input means for generating transaction information based on the designated transaction; stock control means for providing stock information including stocks available in the game and the prices thereof; and display control means responsive to the transaction control means and the stock control means for determining the appropriate display means for indicating the transaction information and the stock information as a function of the source of the information, and for causing the appropriate display means to indicate the transaction information and the stock information.

3. A market game as in claim 2 in which both the public and private display means include means for providing alphanumeric indications which scroll from right to left.

4. A market game as in claim 2 wherein the input means includes means for designating companies the stock of which is to be purchased or sold, means for designating the type of transaction, and means for designating numbers of shares.

5. A market game as in claim 4 in which the display control means causes the private display means at a particular player position to indicate a share purchase transaction executed at that player position.

6. A market game as in claim 6 in which the display control means further causes the public display means to indicate the share purchase transaction if that player position has accumulated a selected number of the shares.

7. A market game as in claim 2 wherein the input means associated with each player also includes means for signaling the transaction control means to sell short shares of a stock.

8. A market game as in claim 2 wherein the input means associated with each player position also includes means for signaling the transaction control means to place a call for shares of a stock.

9. A market game as in claim 2 wherein the input means associated with each player position also includes means for signaling the transaction control means to place a put for shares of a stock.

10. A market game as in claim 2 which further comprises input means by which a player may designate amounts to be borrowed, and in which the display control means causes the private display means to indicate a credit line at that particular player position.

11. A market game as in claim 10 in which the input means further includes means at each player position for paying back amounts borrowed.

12. A market game as in claim 10 in which the transaction control means includes means for automatically collecting amounts borrowed.

13. A market game as in claim 10 in which the display control means causes the private display means to indicate margin calls.

14. A market game as in claim 2 in which the transaction control means includes means for assigning a specified cash amount to each player position, and means for summing the cash held at each player position; and the display control means causes the private display means at each player position to indicate the cash held at that respective player position.

15. A market game as in claim 2 in which the transaction control means includes means for assigning initial assets to each player position, and means for summing the assets of each player position; and the display control means causes the private display means at each player position to indicate the assets accumulated at that respective player position.

16. A market game as in claim 15 in which the display control means causes the public and private display means to indicate when the assets accumulated at a player position aggregate over a selected value.

17. A market game as in claim 15 in which the display control means causes the public and private display means to indicate when the assets accumulated at a player position aggregate less than a selected value.

18. A market game as in claim 2 in which the display control means causes the public display means to indicate dividends for each stock available, and the transaction control means causes dividends to be paid to player positions owning stock.

19. A market game as in claim 2 in which the display control means causes the public display means to exhibit messages indicative of conditions affecting the price of stocks available, and the stock control means includes means for varying the prices of stocks available in accordance with the messages.

20. A market game as in claim 2 in which the stock control means further comprises means for selecting an initial price for each stock available, and means for selecting a price trend for each stock by which the price of such stock varies from the initial price as stock price quotes continue.

21. A market game as in claim 20 in which the stock control means further comprises means for varying the price trend of a company.

22. A market game as in claim 21 in which the means for varying the price trend of a company is responsive to economic news.

23. A market game as in claim 21 in which the means for varying the price trend of a company is responsive to a maximum price.

24. A market game as in claim 21 in which the means for varying the price trend of a company operates on a random basis.

25. A market game as in claim 21 further comprising input means for varying the price index of a company, and in which the means for varying the price trend of a company is responsive to the means for varying the price index of a company.

26. A market game as in claim 20 in which the display control means causes the public display means to indicate that a company is bankrupt if its stock price falls below a prescribed amount.

27. A market game as in claim 26 in which the stock control means comprises means for valuing stock of a bankrupt company accumulated at a player position at zero.

28. A market game as in claim 20 in which the display control means causes the public display means to indicate that the shares of a stock in a company are splitting when the price of those shares reaches a maximum.

29. A market game as in claim 2 further including personal event control means for randomly generating personal event information affecting the net worth of a particular player, and in which the display control means is further responsive to the personal event control means for causing the private display means at the particular player position to indicate the personal event information.

* * * * *